US009551550B2

(12) United States Patent
Wells

(10) Patent No.: US 9,551,550 B2
(45) Date of Patent: Jan. 24, 2017

(54) RAIL MOUNTABLE DEVICE

(71) Applicant: SureFire, LLC, Fountain Valley, CA (US)

(72) Inventor: William Wells, Costa Mesa, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 14/599,187

(22) Filed: Jan. 16, 2015

(65) Prior Publication Data

US 2016/0209167 A1 Jul. 21, 2016

(51) Int. Cl.
*F41G 1/35* (2006.01)
*F41C 27/00* (2006.01)
*F41G 11/00* (2006.01)

(52) U.S. Cl.
CPC ..... *F41G 1/35* (2013.01); *F41C 27/00* (2013.01); *F41G 11/003* (2013.01)

(58) Field of Classification Search
CPC ..... F41G 1/32; F41G 1/34; F41G 1/35; F41G 1/36; F41G 11/003; F41G 11/004
USPC ..... 42/114, 117, 142, 146
See application file for complete search history.

(56) References Cited

U.S. PATENT DOCUMENTS

D95,274 S 4/1935 Levy
3,405,448 A 10/1968 Weatherby
3,986,285 A 10/1976 Krisay
4,856,218 A 8/1989 Reynolds, Jr.
5,144,752 A 9/1992 Boeke et al.
5,155,915 A 10/1992 Repa
5,430,967 A 7/1995 Woodman, III et al.
5,680,725 A 10/1997 Bell
D398,410 S 9/1998 Fell et al.
5,913,669 A 6/1999 Hansen et al.
6,073,901 A 6/2000 Richter
6,295,754 B1 * 10/2001 Otteman ..... F41G 1/38 42/111
6,526,688 B1 3/2003 Danielson et al.
6,574,901 B1 6/2003 Solinsky et al.
6,598,333 B1 * 7/2003 Randazzo ..... F41G 11/003 42/124
6,874,269 B2 4/2005 Chen et al.
7,117,624 B2 10/2006 Kim
7,188,978 B2 * 3/2007 Sharrah ..... F21S 9/02 248/216.4
7,225,578 B2 6/2007 Tai
D548,385 S 8/2007 Sharrah et al.
7,310,903 B2 12/2007 Kim
(Continued)

OTHER PUBLICATIONS

Wells, William, "Lighting Device", Design U.S. Appl. No. 29/478,936, filed Jan. 9, 2014, 10 pages.

*Primary Examiner* — Stephen M Johnson
(74) *Attorney, Agent, or Firm* — Haynes and Boone, LLP

(57) ABSTRACT

A rail mountable device may be provided that is configured to be secured firmly to a rail, such as a rail on a firearm, and released easily from the rail. In one example, the rail mountable device may include a rail clamp that includes first and second rail-engaging surfaces of corresponding first and second ramp members and a cross member that, in response to rotation of a screw, move toward or away from the longitudinal faces of the rail of the firearm to secure or release the rail mountable device to or from the rail. Additional embodiments and related methods are provided.

18 Claims, 23 Drawing Sheets

(56) References Cited

U.S. PATENT DOCUMENTS

| | | | | |
|---|---|---|---|---|
| 7,325,352 | B2 | 2/2008 | Matthews et al. | |
| 7,334,365 | B2 * | 2/2008 | Kim | F41G 11/003 42/124 |
| D567,894 | S | 4/2008 | Sterling et al. | |
| D568,508 | S | 5/2008 | Howe et al. | |
| D578,599 | S | 10/2008 | Cheng | |
| 7,441,364 | B2 | 10/2008 | Rogers et al. | |
| D581,586 | S | 11/2008 | Conroy | |
| D585,516 | S | 1/2009 | Smith | |
| 7,493,722 | B2 | 2/2009 | Howe et al. | |
| 7,562,484 | B2 * | 7/2009 | Kim | F41G 11/003 24/282 |
| 7,576,515 | B2 | 8/2009 | Greenslade | |
| D600,772 | S | 9/2009 | Swan | |
| 7,591,098 | B2 | 9/2009 | Matthews et al. | |
| 7,614,760 | B2 | 11/2009 | Sharrah et al. | |
| D612,970 | S | 3/2010 | Sharrah et al. | |
| D616,956 | S | 6/2010 | Hamilton | |
| 7,731,380 | B2 | 6/2010 | Wu | |
| 7,735,255 | B1 | 6/2010 | Kincaid et al. | |
| D628,323 | S | 11/2010 | Matthews et al. | |
| D628,324 | S | 11/2010 | Matthews et al. | |
| 7,905,624 | B2 | 3/2011 | Bushee et al. | |
| 8,020,335 | B2 * | 9/2011 | Larsson | F41G 11/003 42/124 |
| 8,276,307 | B2 * | 10/2012 | Deros | F41G 11/003 42/127 |
| 8,287,157 | B2 | 10/2012 | Sharrah et al. | |
| D674,858 | S | 1/2013 | Galli | |
| 8,371,729 | B2 | 2/2013 | Sharrah et al. | |
| 8,387,294 | B2 | 3/2013 | Bolden | |
| 8,499,484 | B2 | 8/2013 | Schneider et al. | |
| 8,752,325 | B2 | 6/2014 | Ding et al. | |
| D709,158 | S | 7/2014 | Wells | |
| D712,001 | S | 8/2014 | Wells | |
| 2004/0068913 | A1 | 4/2004 | Solinsky et al. | |
| 2005/0217162 | A1 | 10/2005 | Matthews et al. | |
| 2007/0227056 | A1 | 10/2007 | Howe et al. | |
| 2007/0240355 | A1 | 10/2007 | Hsu | |
| 2008/0134562 | A1 | 6/2008 | Teetzel | |
| 2009/0122527 | A1 | 5/2009 | Galli | |
| 2010/0164401 | A1 | 7/2010 | Matthews et al. | |
| 2013/0047486 | A1 | 2/2013 | Ding et al. | |
| 2013/0133238 | A1 | 5/2013 | Quetschke et al. | |

* cited by examiner

RAIL MOUNTABLE DEVICE

TECHNICAL FIELD

This invention relates the mounting of accessory devices to firearms.

BACKGROUND

It is often useful to mount an accessory device, such as a lighting device, to a rail that may be secured to or integrated into a firearm such as a handgun. When the rail is disposed on a firearm, it is of utmost importance that the mounting apparatus, which interfaces the accessory device and the rail, be firmly clamped or otherwise firmly secured to the rail, while at the same time it is desirable that the accessory device be quickly and easily securable to and removable from the rail.

Conventional apparatuses for mounting of accessory devices are typically complicated and require large numbers of moving parts. For this reason, the accessory devices can be difficult to install and remove and can be prone to failure due to failure of one or more of the moving parts. This can be problematic, particularly in military or police operations in which failures or excessive time or energy to install or remove the device can be dangerous. Moreover, conventional apparatuses for mounting of accessory devices can be bulky and heavy and can therefore negatively affect the aiming of the firearm when mounted and can be difficult to install on small firearms such as handguns. It would therefore be desirable to provide improved systems and methods for mounting of accessory devices to a rail.

SUMMARY

In one embodiment, a rail mountable device may be configured to be mounted on a rail associated with a weapon and may include a housing and a rail clamp. The rail clamp may include first and second opposed ramp members, a cross member connected to the second ramp member, and a screw adapted to project through the first ramp member and be received by the cross member along a central axis. The ramp members may be simultaneously pulled toward each other along the central axis and moved toward the rail in a direction substantially perpendicular to the central axis in response to a rotation of the screw to lock the device with respect to the substantially perpendicular direction.

In another embodiment, a method is provided that includes providing a device configured to mount on a rail associated with a weapon, the device including a housing and a rail clamp that includes first and second opposed ramp members, a cross member connected to the second ramp member, and a screw adapted to project through the first ramp member and be received by the cross member along a central axis; and rotating the screw, where the ramp members are simultaneously pulled toward each other along the central axis and toward the rail in a direction substantially perpendicular to the central axis in response to the rotating to lock the device with respect to the substantially perpendicular direction.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

In accordance with various embodiments provided herein, a rail mountable device may be implemented to easily mount an accessory onto the rail of a firearm. Such a rail mountable device may be used in any desired combination with various features identified in the present disclosure. In certain embodiments, a rail mountable device may be particularly suited for use in tactical and combat environments (e.g., for mounting a light source on a weapon or other device).

Figure 1A:
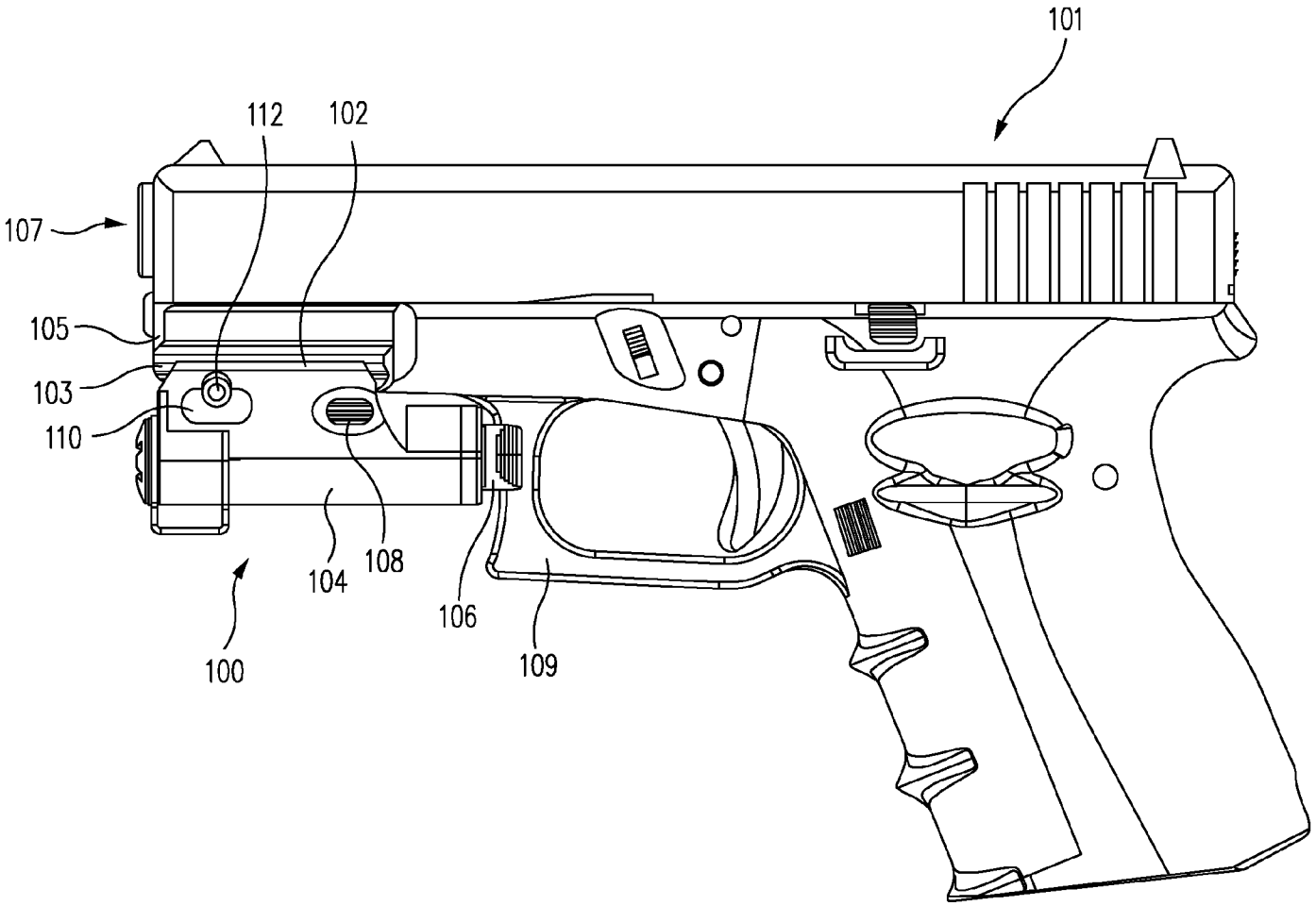
FIGS. 1A, 1B, and 1C illustrate several views of a rail mountable device attached to a weapon in accordance with several embodiments of the disclosure.
Figure 1B:
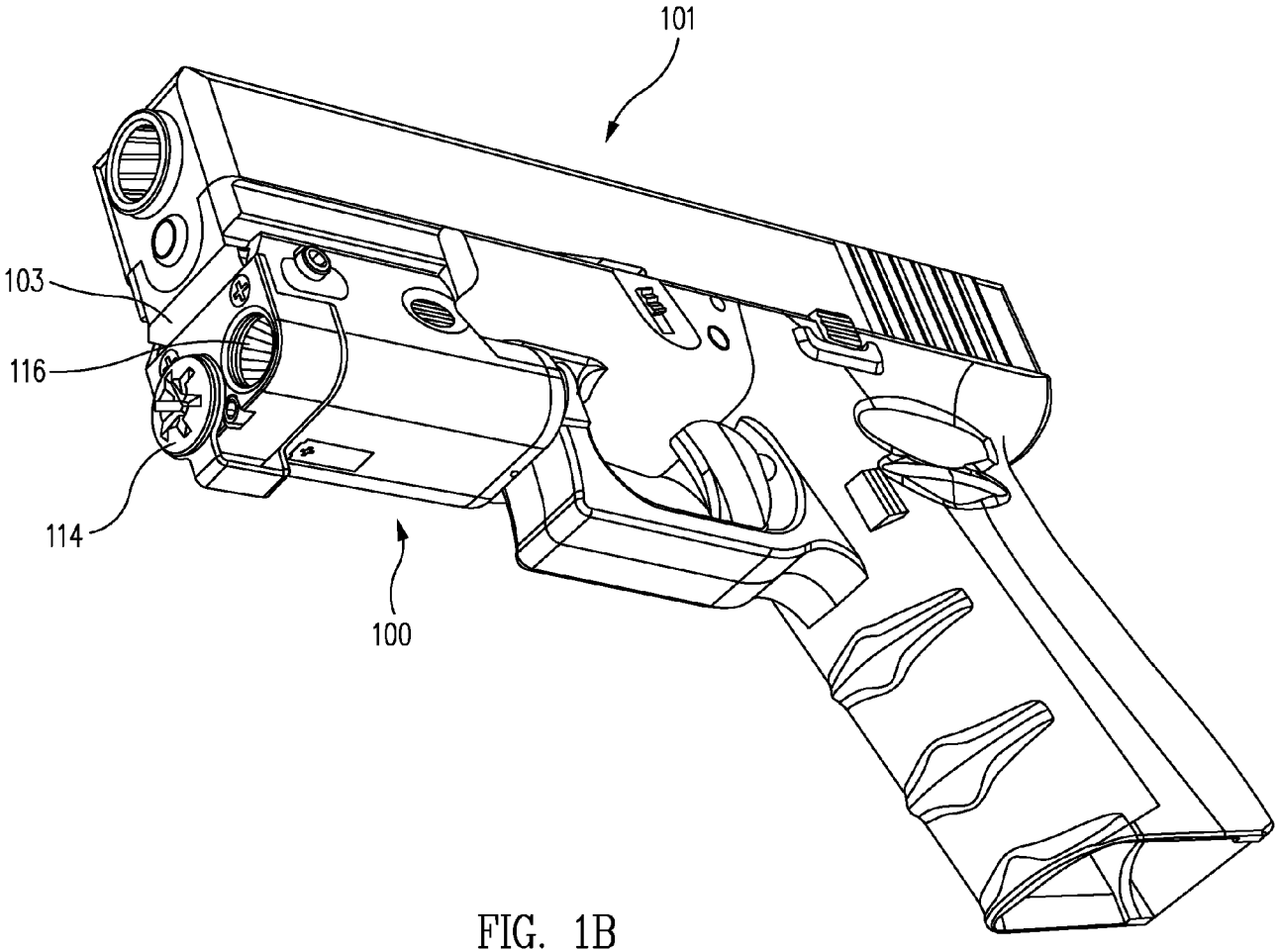
Figure 1C:
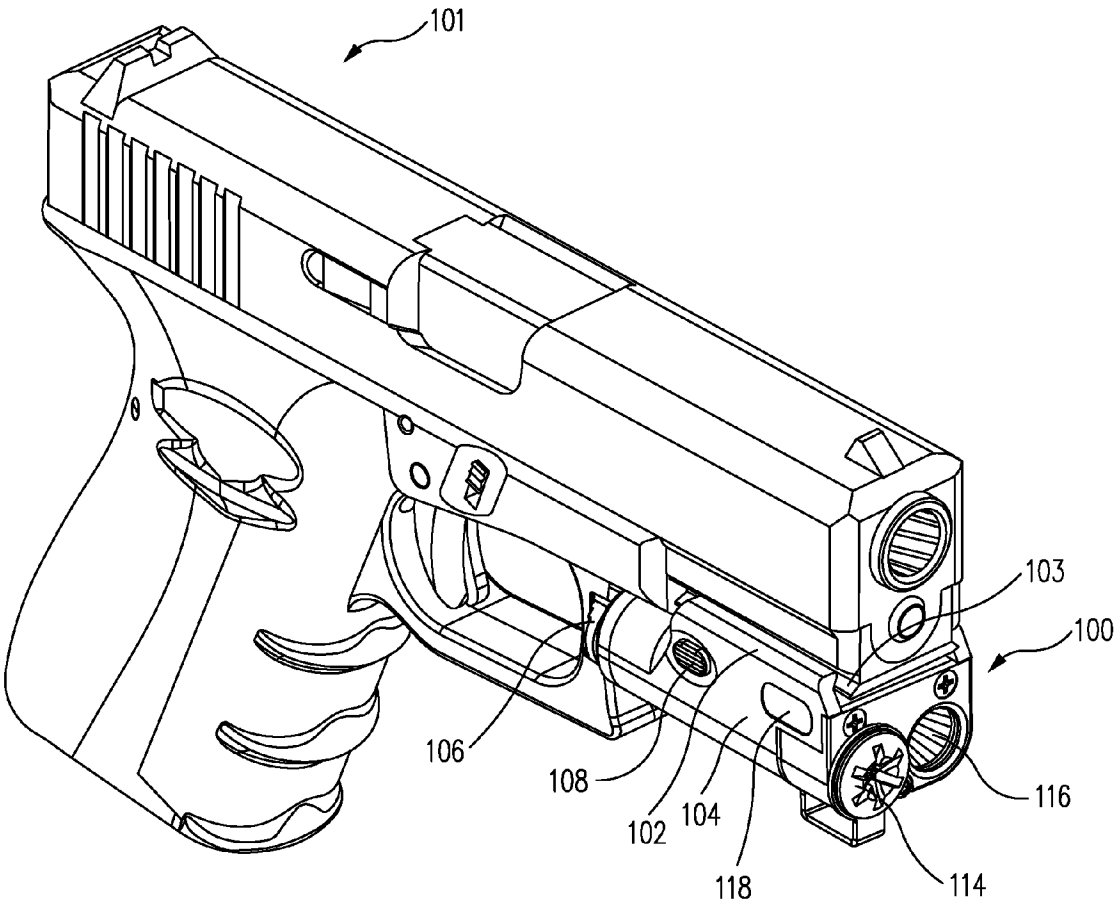

Referring now to the drawings, wherein the showings are for purposes of illustrating embodiments of the present invention only and not for purposes of limiting the same, FIGS. 1A, 1B, and 1C illustrate rail mountable device 100 attached to a weapon 101 using a configuration in accordance with several embodiments of the invention.

FIG. 1A illustrates a side view of rail mountable device 100 attached to rail 103 of firearm 101. As shown in FIG. 1A, rail mountable device 100 may be mounted to rail 103, which may be, for example, a picatinny rail or universal rail, of weapon 101 (e.g., a firearm such as a handgun) and that runs parallel to the length of the barrel of firearm 101. Rail mountable device 100 may include a housing 104 (sometimes referred to as a main housing). Housing 104 may have various features configured to help mount rail mountable device 100 to a rail such as rail 103. For example, rail mountable device 100 may be secured to rail 103 in part with a rail engaging member 102 of housing 104. Rail 103 may be integral or removeably secured at various locations on frame 105 of firearm 101. In the example of FIG. 1A, rail 103 is located beneath the barrel 107 of firearm 101 and forward of the trigger guard 109 of firearm 101. In some embodiments, rail 103 may have at least one groove or slot 900 (see FIGS. 9A and 9B) that extends in a direction perpendicular to the length of barrel 107.

As shown in FIG. 1A, rail mountable device 100 may include one or more control devices such as switch 106 and switch 108, a screw 112, and a ramp member 110. As shown, screw 112 may be disposed in ramp member 110. In one embodiment, ramp member 110 may be adjustable depending on a rotation of screw 112. For example, ramp member 110 may be configured to move into housing 104 when screw 112 is rotated and to move partially outward of housing 104 to protrude from an outer surface of housing 104 when screw 112 is counter rotated.

Switches 106 and 108 may provide a user of rail mountable device 100 with the ability to operate electronic components of rail mountable device 100 such as one or more light sources disposed within housing 104 and configured to project light (e.g., a beam of visible light, infrared light, ultraviolet light, and/or laser light of various wavelengths) from rail mountable device 100 (e.g., in the direction in which firearm 101 is aimed such as a direction defined by the barrel 107).

FIG. 1B shows a lower front perspective view of rail mountable device 100 attached to rail 103 of firearm 101. As shown in FIG. 1B, rail mountable device 100 may include a battery cap 114 and an optic 116. Optic 116 may include one or more optical elements such as one or more lenses and/or one or more reflectors (e.g., one or more substantially parabolic reflectors and/or one or more reflectors of any other desired shape). Optic 116 may be used in conjunction with at least one light source to provide lighting by rail mountable device 100 (e.g., to project light generated by the light source from housing 104 onto an external scene such as a scene of interest to the user of device 100). Although rail mountable device 100 is primarily described herein as having a reflector, other embodiments are contemplated. For example, in various embodiments, one or more lenses may be provided to guide light from a light source within housing 104 onto the external scene. Optic 116 and one or more associated light sources may be configured to project light of various different wavelengths from rail mountable device 100.

FIG. 1C shows an upper front perspective view of rail mountable device 100 attached to rail 103 of firearm 101 and, in combination with FIG. 1A, shows how rail mountable device may include rail engaging members 102 on opposing sides of housing 104. FIGS. 1A and 1C also show how control devices such as switches 106 and 108 may be provided on multiple sides of rail mountable device for ambidextrous use by a user. In an embodiment, switches 106 and 108 may be positioned for convenient access by a user of firearm 101 to aid the user in controlling light generated by rail mountable device 100 while the user also operates firearm 101. For example, the user may conveniently actuate switch 106 (e.g., by way of the user's thumb or finger) while holding the vertical grip of firearm 101 to turn on, turn off, or increase or decrease the brightness of the light from rail mountable device. Switch 106 may provide a different function from switch 108 in some embodiments. For example, switch 106 may be a momentary-on switch and switch 108 may be a constant-on switch.

In various embodiments, rail engaging-members 102 may be integral portions of housing 104 or may be separate structures which can be mounted to or otherwise attached to housing 104.

As shown in FIG. 1C, rail mountable device 100 may include an additional ramp member 118 on an opposing side of rail mountable device 100 to the side on which ramp member 110 having screw 112 is disposed. In the example of FIG. 1C, ramp member 118 is disposed completely within housing 104 as rail mountable device 100 is shown in an engaged configuration. Ramp member 118 may move to protrude relative to the outer surface of main housing 104 in response to a rotation of screw 112 (e.g., an unscrewing rotation) on opposing side of main housing 104 according to one or more embodiments. Ramp members 110 and 118 may be configured to cooperate with other internal structures of rail mountable device 100 to clamp rail mountable device 100 to rail 103 as discussed in further detail hereinafter.

Figure 2A:
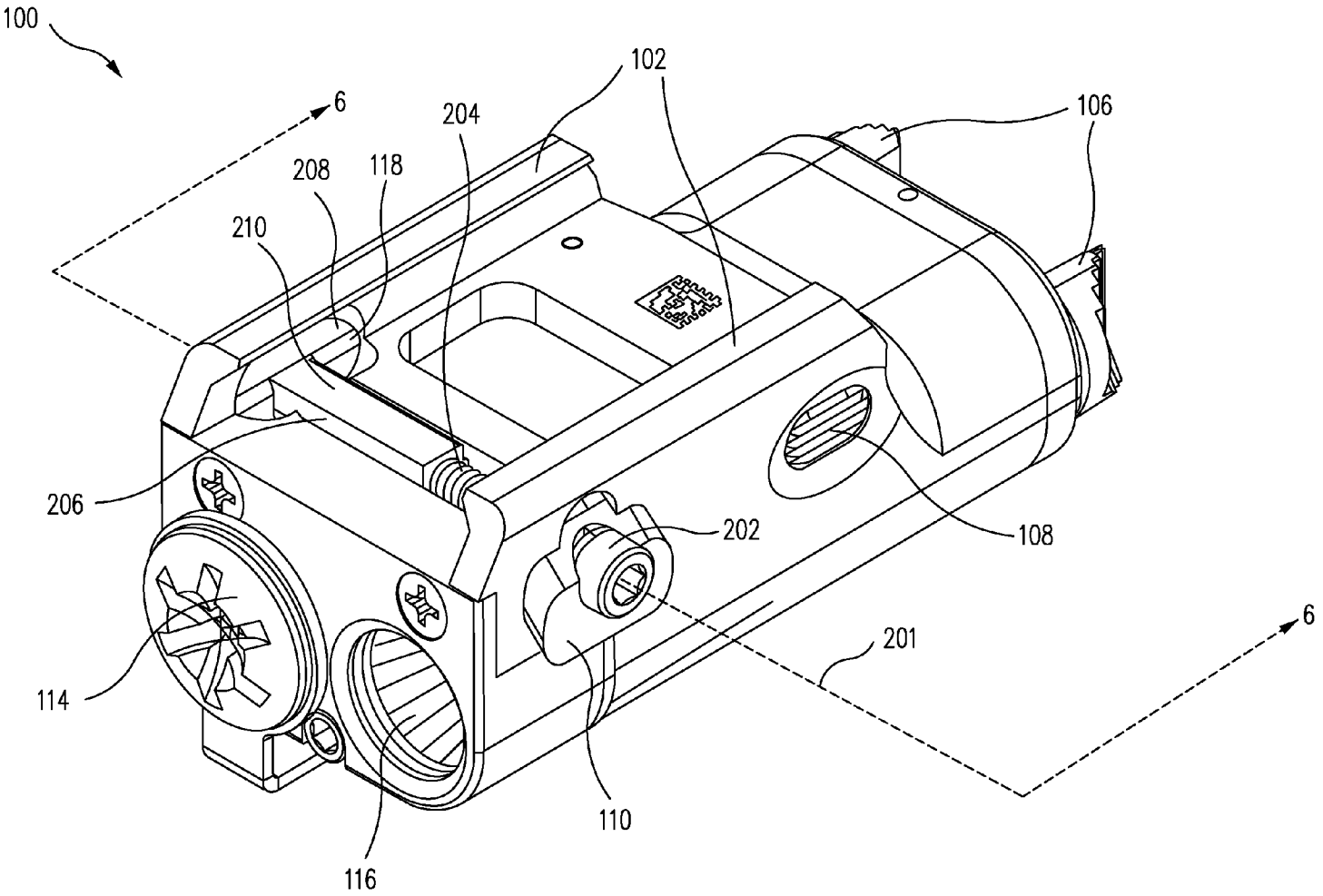
FIGS. 2A, 2B, and 2C illustrate several views of a rail mountable device in a disengaged configuration in accordance with several embodiments of the disclosure.
Figure 2B:
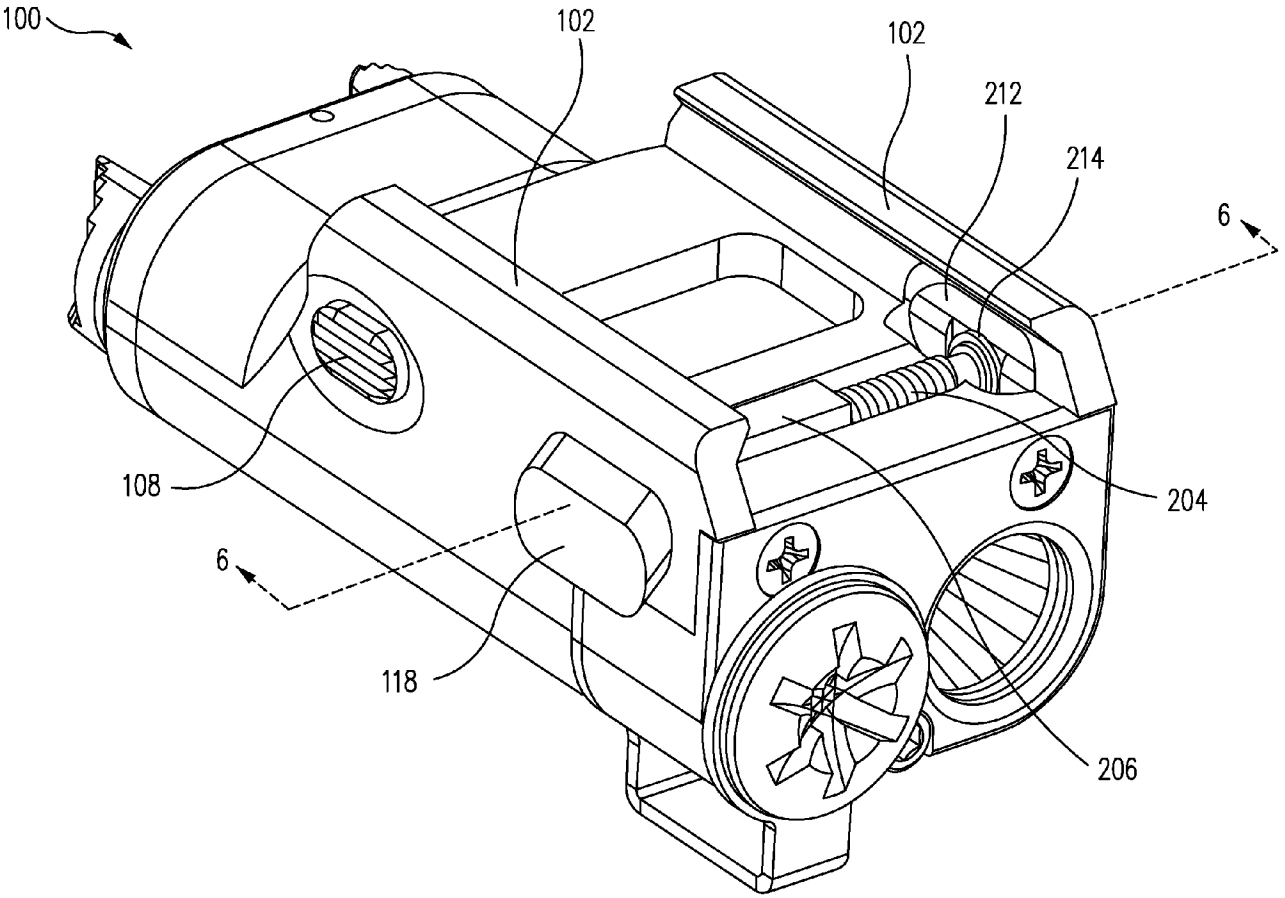
Figure 2C:
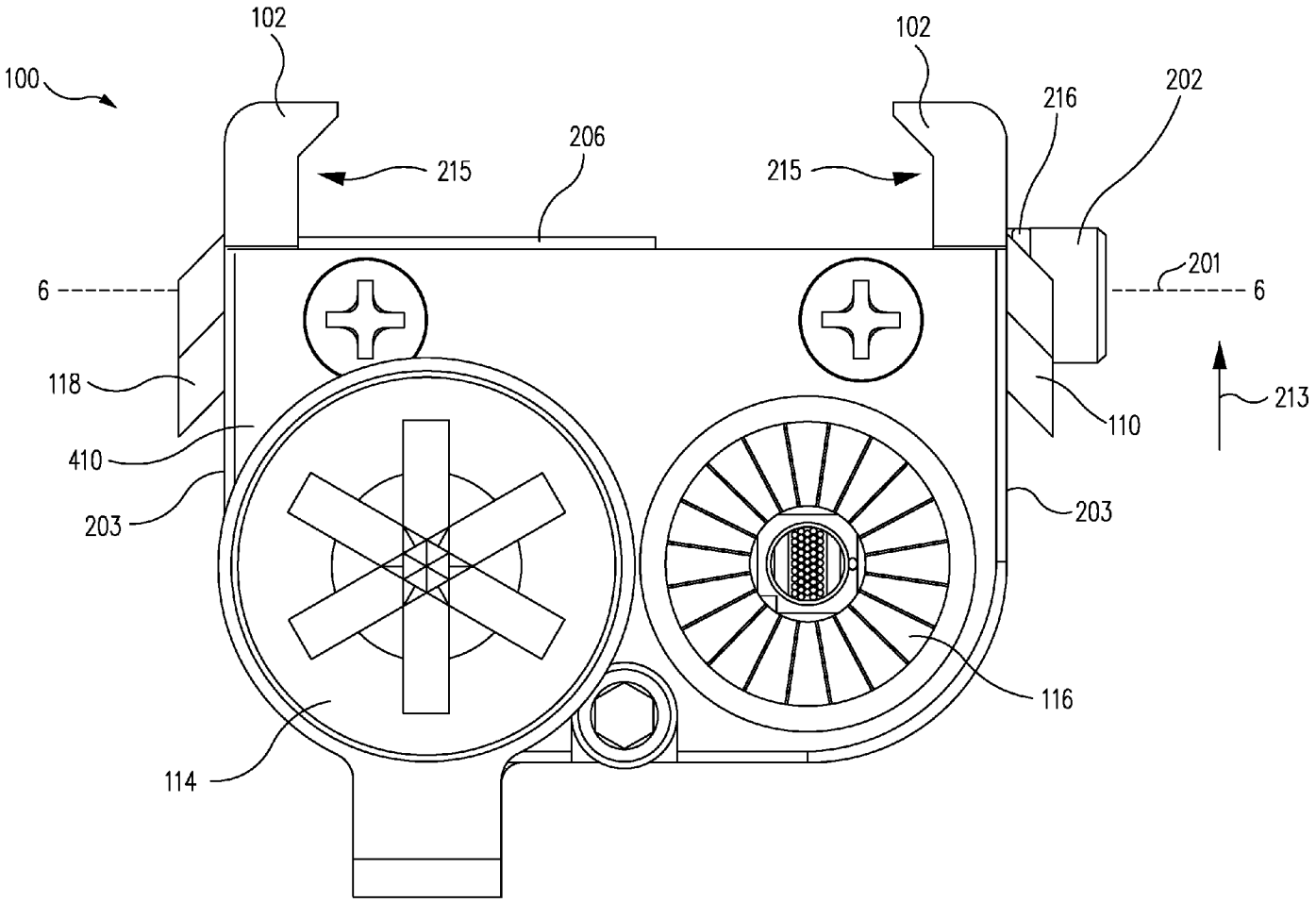

FIGS. 2A, 2B, and 2C provide various views of rail mountable device 100 separately from a rail and in a disengaged configuration in accordance with several embodiments of the invention.

FIG. 2A shows a left upper front perspective view of rail mountable device 100 in a disengaged configuration. In the disengaged configuration of FIGS. 2A, 2B, and 2C, screw 112 is in an unscrewed position which results in disengaged positions for ramp members 110 and 118 as well as a cross member 206.

As shown in FIG. 2A, ramp member 110 may reside in main housing 104 and may be adapted to receive screw 112. Screw head 202 of screw 112 may protrude relative to an outer surface of ramp member 110. Screw body 204 of screw 112 may be disposed within housing 104 and may be received by internally threaded cross member 206. Cross member 206 may be connected or attached to ramp member 118. For example, ramp member 118 and cross member 206 may be integrally formed or may be attached using an adhesive, a weld, or other attachment mechanism.

Ramp member 118 may have an internal surface such as rail-engaging surface 208. Rail engaging surface 208 may be disposed adjacent to one side (e.g., an internal side) of a corresponding rail-engaging member 102 of housing 104. For example, rail-engaging surface 208 may reside below a mating face of a corresponding rail-engaging member 102 in such a way that, when screw 112 is turned and surface 208 moves inward, surface 208 and a surface of rail engaging member 102 form an angled surface that mimics the shape of the intended mounting rail, such as rail 103.

Running parallel to the length of threaded cross member 206 and centrally through cross member 206 and screw 112 is a central axis 201 of cross member 206 and screw Dashed line 6-6 of FIGS. 2A, 2B, and 2C runs along the central axis 201. Cross member 206 may have a size and a shape so as to be received by at least one transverse groove in rail 103 in response to tightening of screw 112.

FIG. 2B shows a right upper front perspective view of rail mountable device 100 in the disengaged configuration. As shown in FIG. 2B, ramp member 118 may include a rail-engaging surface 212 configured to simultaneously engage a rail such as rail 103 in conjunction with rail-engaging surface 208 of ramp member 118 in response to rotation of screw 112 concentrically about the central axis. In the example of FIG. 2B, ramp member 118 is in a disengaged position and protrudes from the outer surface of main housing 104. Screw body 204 is positioned rearwardly in cross member 206 (i.e. the threading of screw body 204 is at least partially removed from internal threading of cross member 206). Further, in the disengaged configuration, ramp members 110 and 118 are in disengaged positions relatively further apart than in an engaged position when screw 112 is screwed in.

As shown in FIG. 2B, rail mountable device 100 may include a washer 214 on the neck of screw body 204 that aids in securing screw 112 into cross member 206. Washer 214 may, for example, be a c-washer or any other suitable washer.

FIG. 2C shows a front view of rail mountable device 100 in a disengaged configuration. As shown in FIG. 2C, ramp members 110 and 118 are in disengaged positions and projecting outward from the outer surfaces 203 of main housing 104 and do not extend inward of members 102 of housing 104. Screw 112 may be fastened to ramp member 110 using washer 214 (e.g., a c-washer) and an additional washer 216 (e.g., a split lock washer).

When screw 112 is rotated about the central axis (e.g., in a clockwise direction) ramp members 118 and 110 may be pulled inwardly along the central axis and, due to ramping surfaces of ramp members 118 and 110 and housing 104 may also be pulled upwardly (e.g., in a direction 213) that is relatively perpendicular to the central axis.

As shown in FIG. 2C, rail-engaging members 102 on opposing sides of rail mountable device 100 may include opposing inward directed wedge-shaped surfaces 215 (in cross-section) that run longitudinally (e.g., parallel to length of device 100 from the front to the back in the direction of an intended rail to be mounted).

Figure 3A:
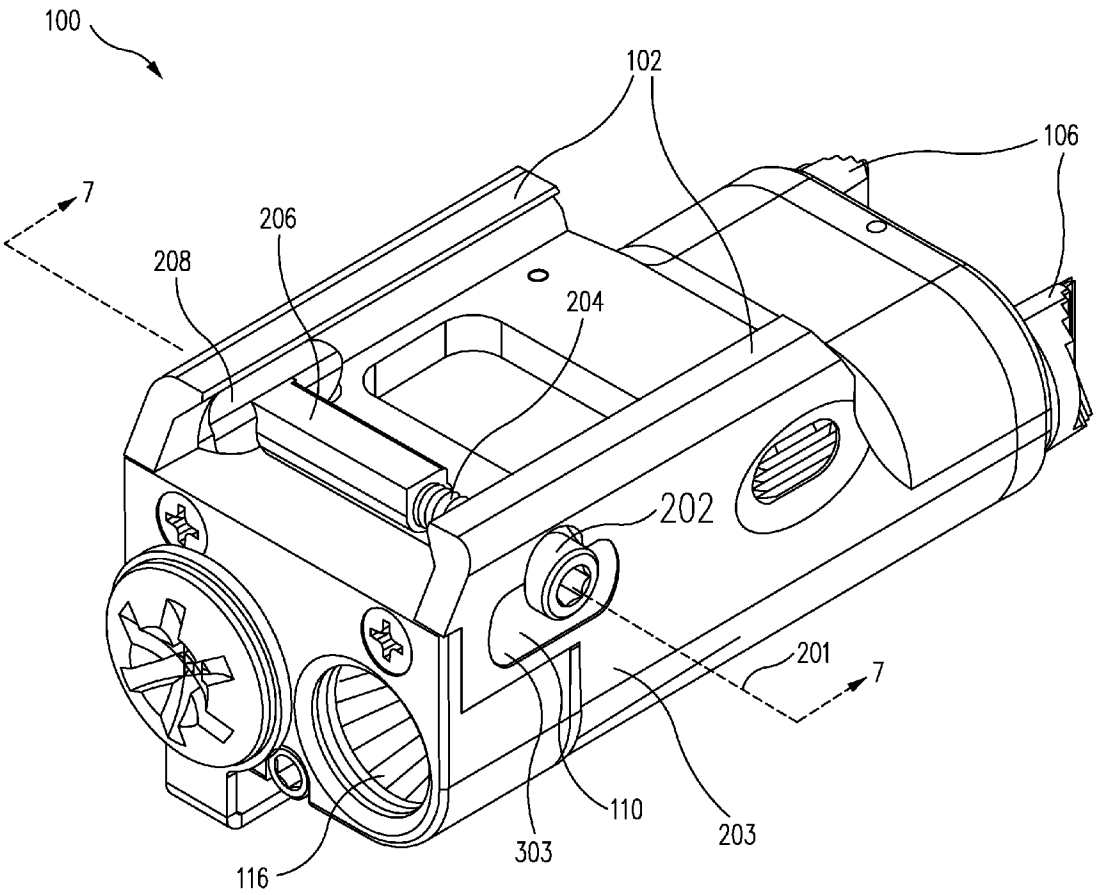
FIGS. 3A, 3B, and 3C illustrate several views of a rail mountable device in an engaged configuration in accordance with several embodiments of the disclosure.
Figure 3B:
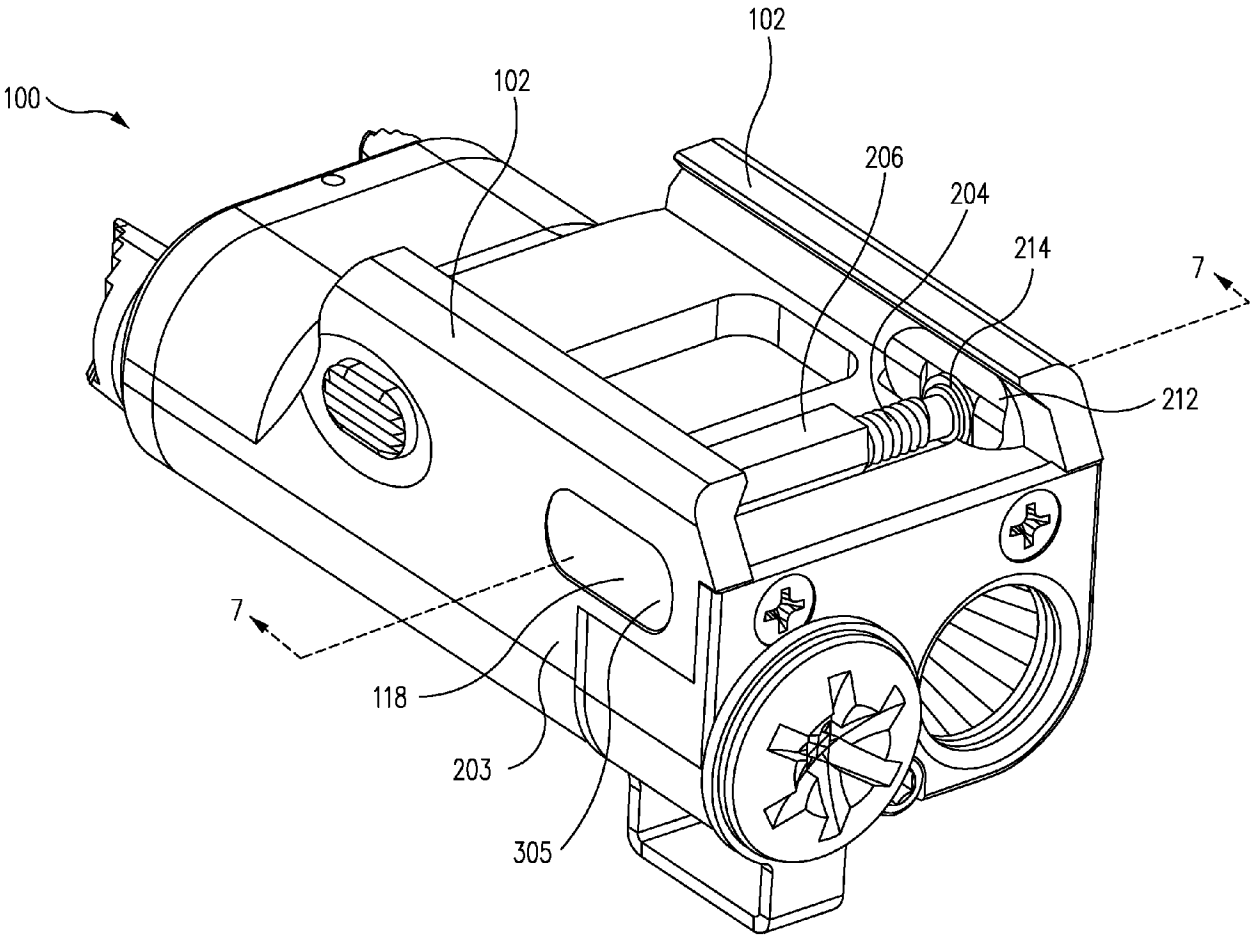
Figure 3C:
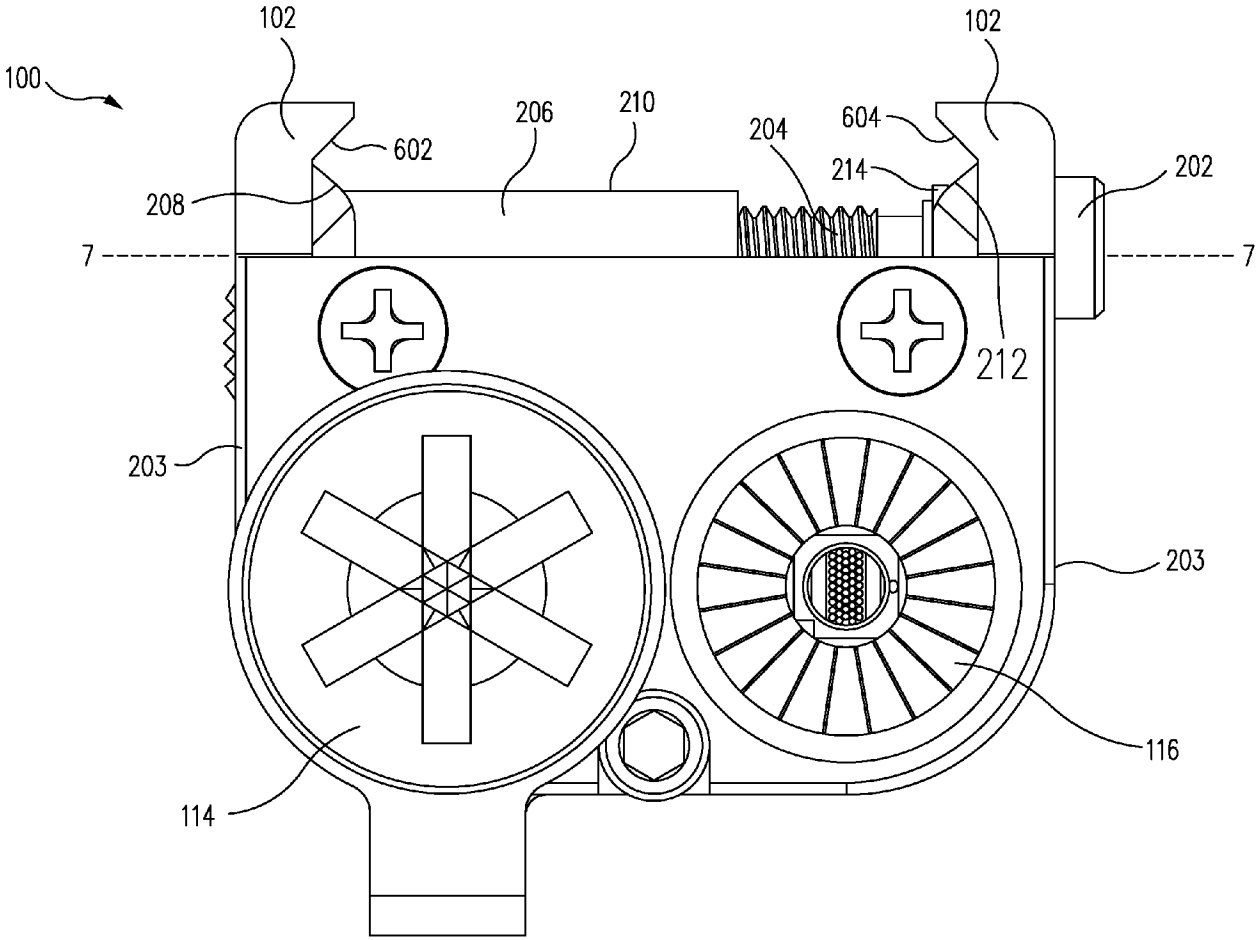

FIGS. 3A, 3B, and 3C provide various views of rail mountable device 100 separately from a rail and in an engaged position in accordance with several embodiments of the present disclosure. Dashed line 7-7 of FIGS. 3A, 3B, and 3C runs along the central axis 201 of cross member 206 and screw 112 which is relatively higher with respect to housing 104 than the location of central axis 201 in FIGS. 2A, 2B, and 2C. In response to rotation (e.g., clockwise rotation) of screw 112, the distance between ramp members 110 and 118 is shortened in addition to ramp members 110 and 118 moving in a direction relatively perpendicular to the central axis. For example, when screw 112 is rotated in a predetermined direction, screw 112 is moved forwardly (e.g., the threading of screw body 204 increases engagement with internal threading of cross member 206) and ramp members 110 and 118 are pulled inward along the central axis toward one another.

FIG. 3A shows a left upper front perspective view of rail mountable device 100 in an engaged configuration. As shown in FIG. 3A, ramp member 110 in the engaged configuration has an engaged position fully internal to the outer surface 203 in main housing 104. In various embodiments, the face 303 of ramp member 110 may be flush or embedded relative to the outer surface 203 of housing 104 in the engaged position. As shown, in the engaged configuration, screw head 202 may protrude relative to surface 303 of ramp member 110 (e.g., to facilitate access to screw head 202 for twisting of screw head 202 to adjust tightness of clamp of rail mountable device 100).

As shown in FIGS. 3B and 3C, in the engaged position, cross member 206 may have an engaged position that is relatively higher within housing 104 than the disengaged position of cross member 206 shown in FIGS. 2B and 2C. For example, when screw 112 is screwed in, ramp members 118 and 110 may interact with housing 104 to move cross member 206. In this way, cross member 206 may be raised into engagement with a transverse groove in a rail to help prevent rail mountable device 100 from sliding longitudinally along the rail. For example, motion of the firearm such as firing of the weapon or, if firearm 101 is used as a concealed weapon, the friction of the removal of firearm 101 from a user's holster, would not cause the rail mountable device to become displaced from its original secured location on the rail.

FIG. 3B shows a right upper front perspective view of rail mountable device 100 in an engaged configuration and shows how ramp member 118 may have an engaged position disposed completely within housing 104 (e.g., so that an outer surface 305 of ramp member 118 may be flush or embedded in relation to the outer surface 203 of main housing 104). In the engaged position, screw body 204 is positioned forwardly in cross member 206 and the distance between ramp members 110 and 118 along the central axis is decreased in comparison to the distance between ramp members 110 and 118 in a disengaged position.

In the front view of rail mountable device 100 of FIG. 3C, it can be seen that, in an engaged configuration, ramp members 110 and 118 may not protrude from housing 104 and rail-engaging surfaces 208 and 212 are pulled inward and upward so that surfaces 208 and 212, and surfaces 602 and 604 of rail-engaging members 102 may have a shape that corresponds to the shape of a rail to be mounted to as will be discussed in further detail hereinafter.

Figure 4:
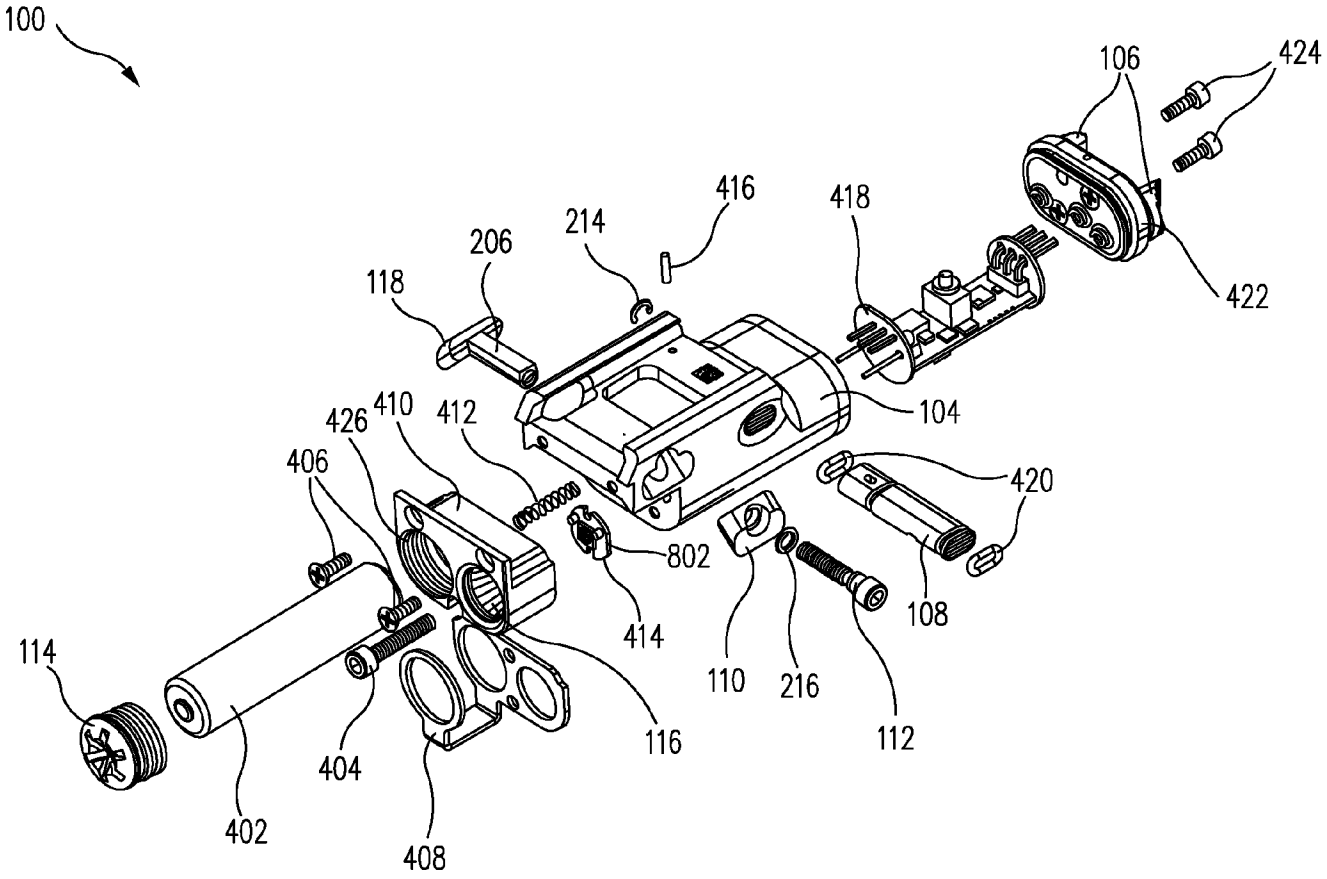
FIG. 4 illustrates an exploded view of a rail mountable device in accordance with an embodiment of the disclosure.

FIG. 4 is an exploded view of rail mountable device 100 according to an embodiment. In the example of FIG. 4, rail mountable device 100 has a cap 114, a battery 402, a compartment 426 (e.g., a battery compartment), a screw 404 (e.g., a socket cap screw), screws 406, a gasket 408, a front housing 410, an optical element such as optic 116, a spring 412, ramp member 110, washer 216, washer 214, screw 112, switch 108, cross member 206, ramp member 118, light source 414, circuit board 802, main housing 104, pin 416, controller board 418, o-rings 420 (e.g., oval o-rings), rear housing 422, switch 106, and screws 424.

Figure 5A:
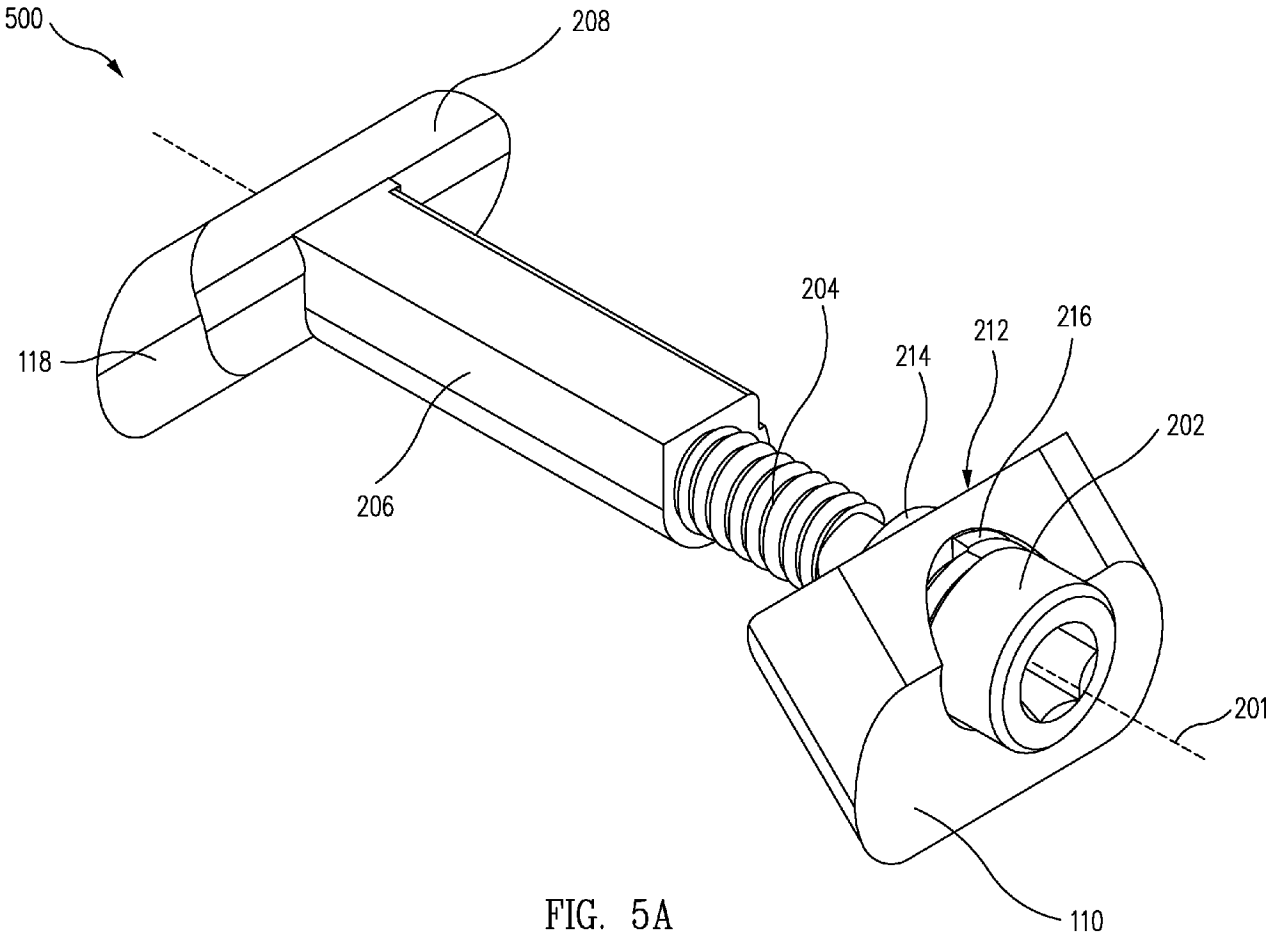
FIGS. 5A, 5B, and 5C illustrate several views of a rail clamp of a rail mountable device in accordance with several embodiments of the disclosure.
Figure 5B:
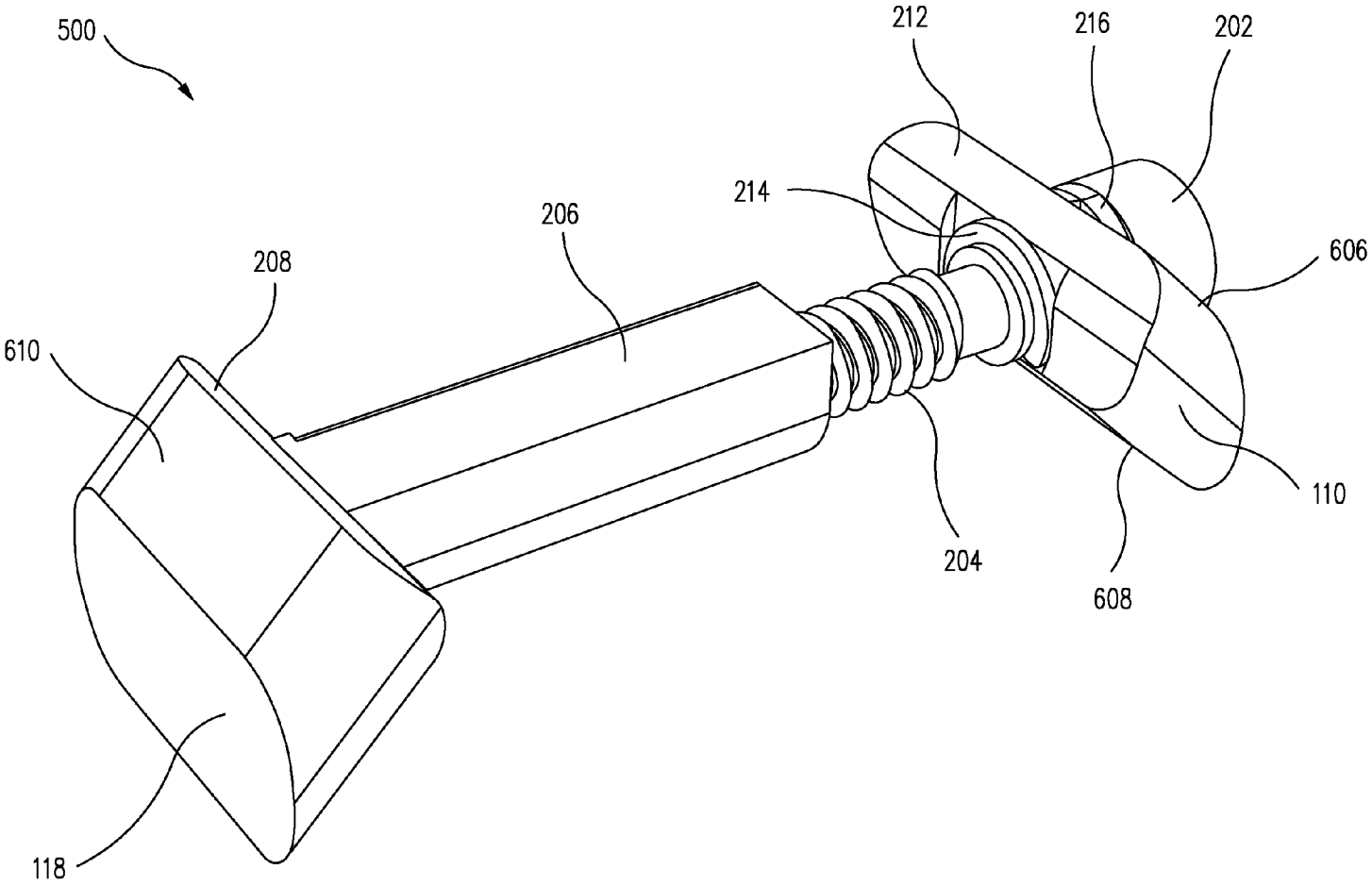
Figure 5C:
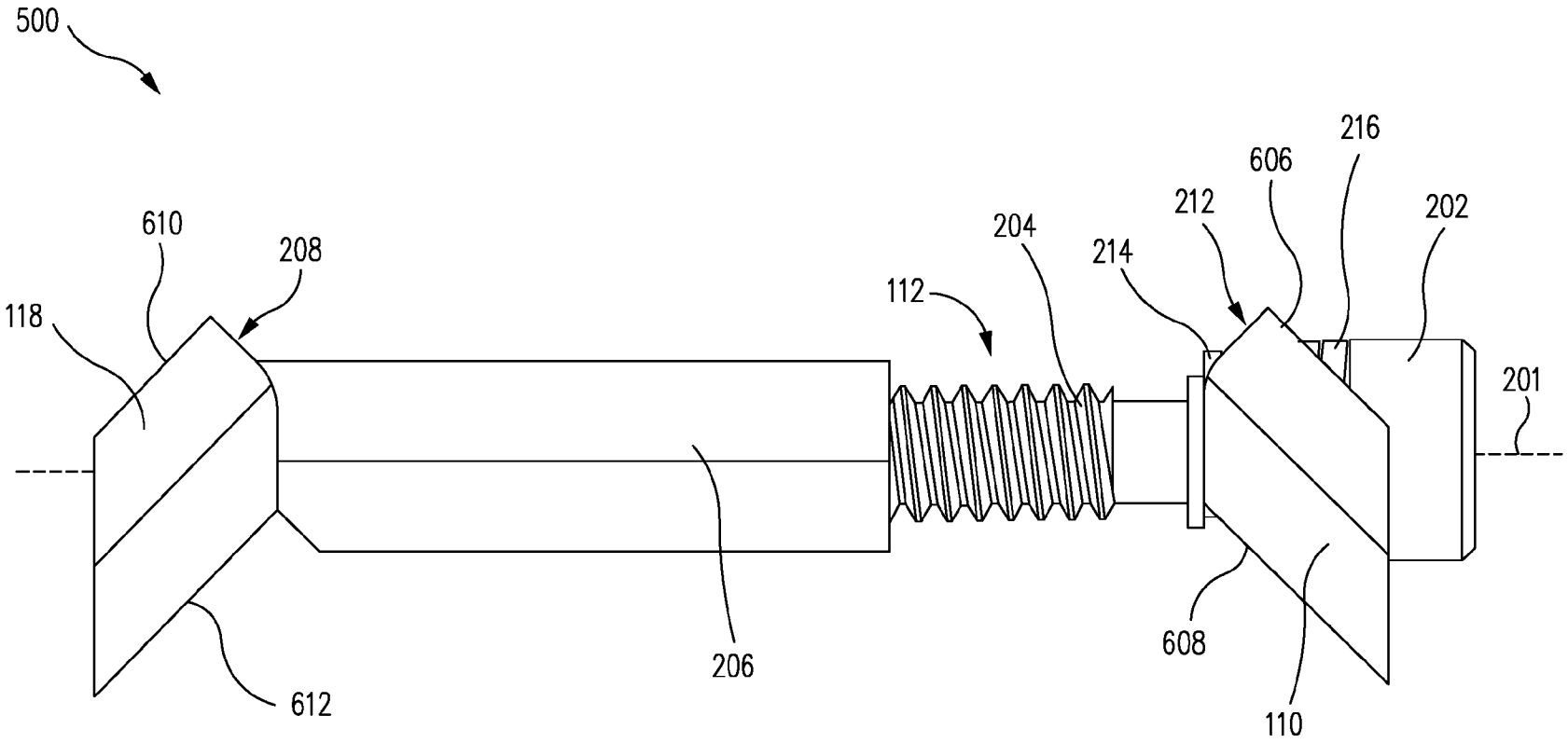

FIGS. 5A-C show several views of a rail clamp 500 formed from screw 112, ramp members 110 and 118, cross member 206, and washers 214 and 216 in accordance with one or more embodiments.

As shown, central axis 201 may be the central axis of rail clamp 500 passing centrally through screw 112, washers 214 and 216, and cross member 206 and through ramp members 110 and 118 and rail-engaging surfaces 208 and 212. It should be appreciated that, due to the ramping effect of ramp members 110 and 118 when screw 112 is turned and rail clamp 500 is disposed in housing 104, the central axis will move with respect to the housing 104 and other components of rail mountable device 100.

As shown in FIG. 5A, cross member 206 may be connected to ramp member 118, which has at least one rail-engaging surface 208 opposed to and transversely spaced from at least one rail-engaging surface 212 of ramp member 110. When screw 112 is turned, screw 112 may move into and out of cross member 206 and thereby pull and push ramp members 110 and 118 along the central axis. Screw body 204 is received by threaded cross member 206. Screw head 202 may be rotated (e.g., clockwise or counter-clockwise) to move ramp members 110 and 118 toward/away from one another in a direction substantially parallel to the central axis.

As shown in FIGS. 5B and 5C, in one or more embodiments, ramp members 110 and 118 include angled surfaces 606, 608, 610, and 612 (e.g., surfaces inclined with respect to the central axis). Surfaces 606, 608, 610, and 612 may track along complementary surfaces of housing 104 when rail clamp 500 is installed in housing 104 to cause rail clamp 500 and all of its components and the central axis to move upward at an angle perpendicular to the central axis when screw 112 is rotated also moving ramp members 110 and 118 toward one another along the central axis. Thus, rail-engaging surfaces 208 and 212 are configured to be moved to matingly engage (e.g., press against) longitudinal surfaces of rail 103 that run in a direction transverse to the central axis of cross member 206 in an engaged configuration. Rail-engaging surfaces 208 and 212 may be shaped to optimize surface contact with rail 103 providing greater security of rail mountable device 100 to rail 103.

Figure 6A:
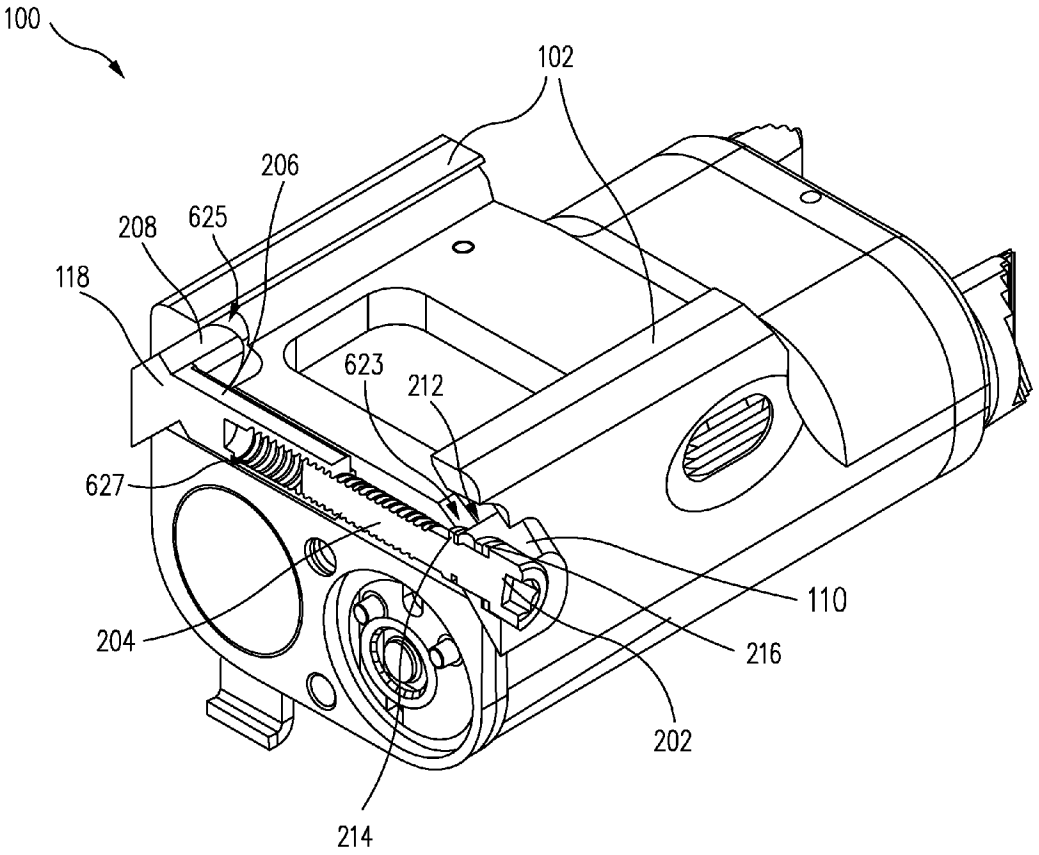
FIGS. 6A, 6B, and 6C illustrate several cross-sectional views of a rail mountable device with a rail clamp in a disengaged position taken along line 6-6 of FIGS. 2A, 2B, and 2C in accordance with several embodiments of the disclosure.
Figure 6B:
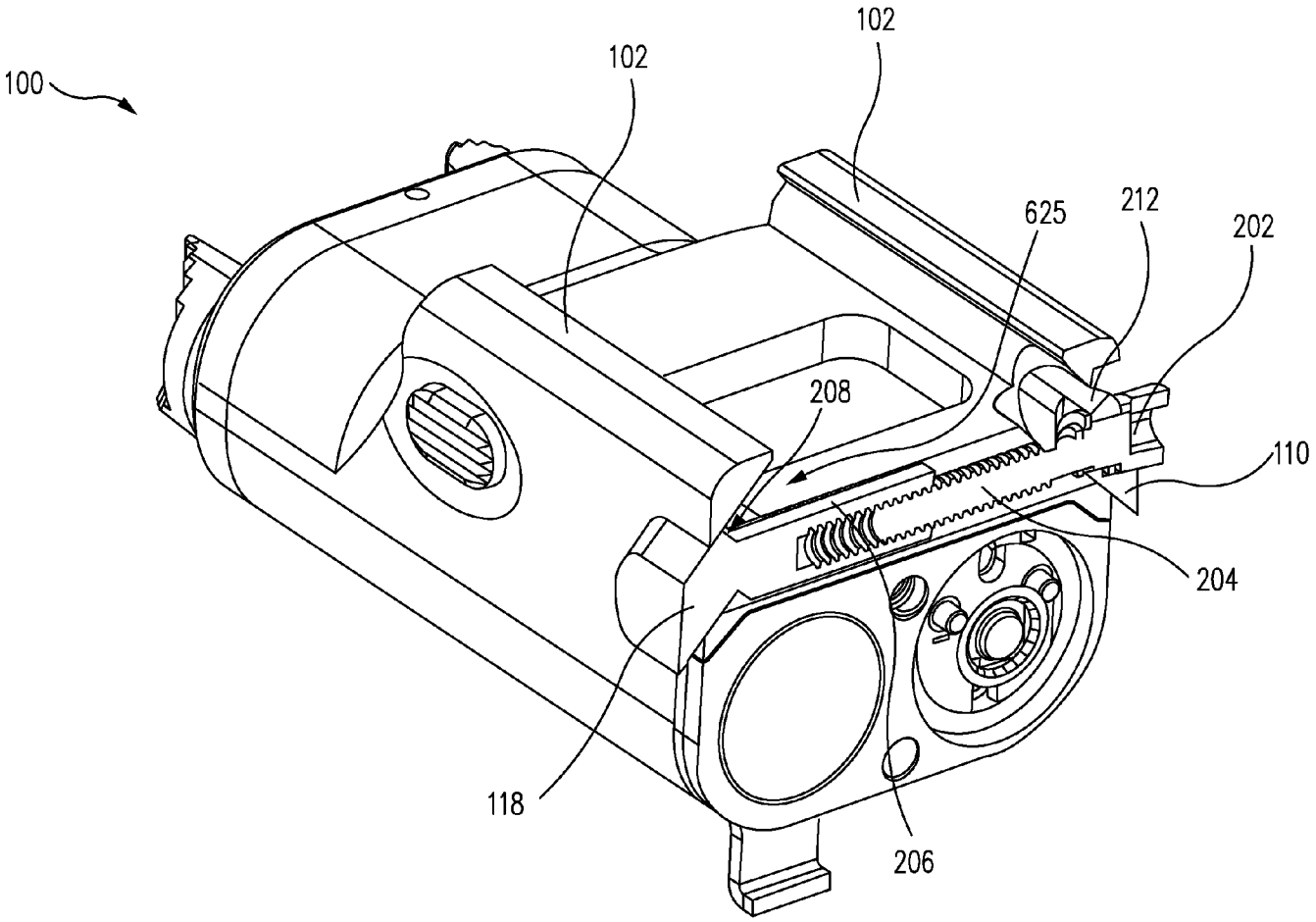
Figure 6C:
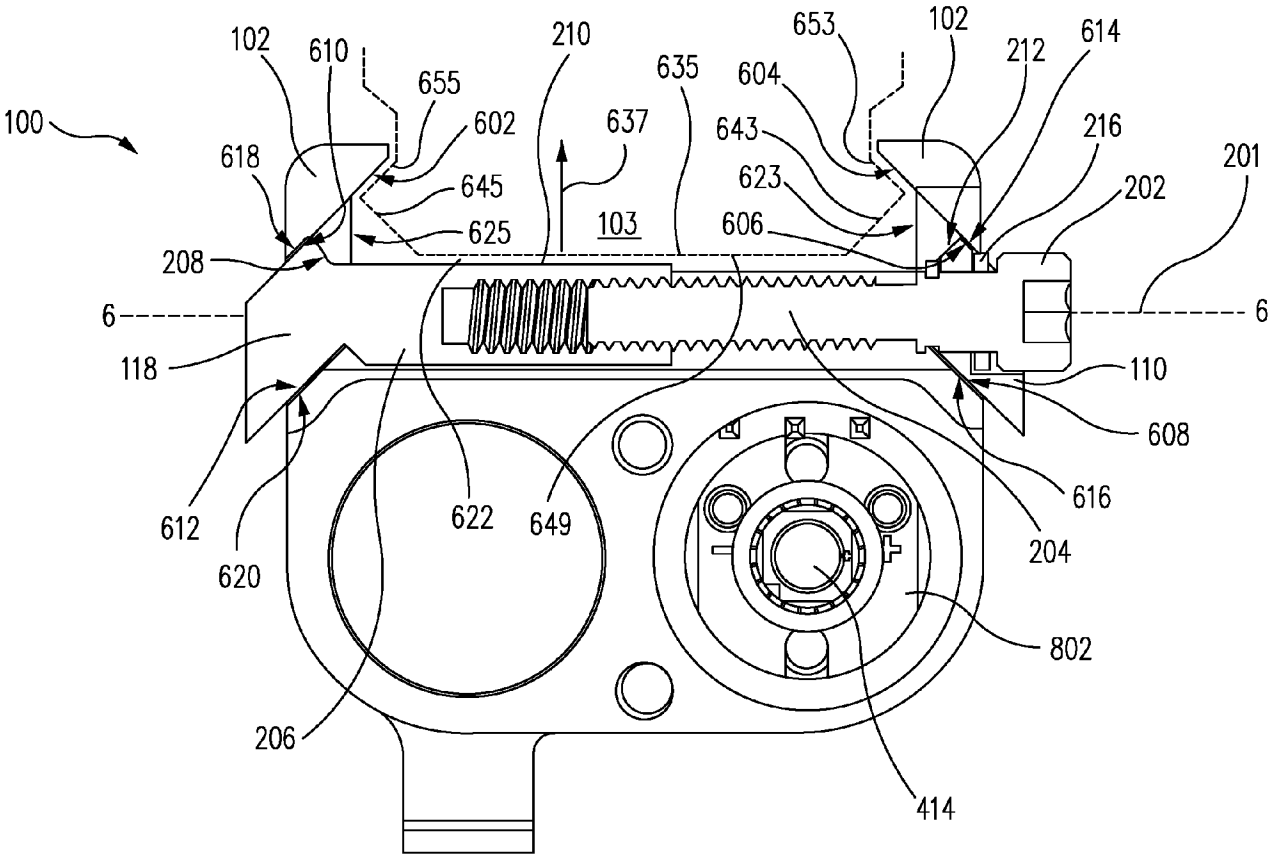

FIGS. 6A, 6B, and 6C show several cross-sectional perspective views of rail mountable device 100 in the disengaged configuration with the cross section taken along line 6-6 of FIGS. 2A, 2B, and 2C (and through the central axis of rail clamp 500) in accordance with one or more embodiments.

FIG. 6A provides a left upper front perspective cross-sectional view of rail mountable device 100 in a disengaged configuration. As shown in FIG. 6A, ramp members 110 and 118 may be disposed in corresponding slots 623 and 625 in housing 104 and may simultaneously slide within their respective slots when screw 112 is rotated. Internal threading 627 in cross member 206 allows screw 112 to rotate about the central axis concentrically. The surfaces of ramp members 110 and 118 are inclined at an angle in relation to the central axis to allow for movement in both an axial and a transverse direction based on contact with complementary respective surfaces within the slot.

FIG. 6B shows a right upper front perspective cross-sectional view of rail mountable device 100. As shown, in the disengaged position, ramp member 118 may protrude from its corresponding slot 625 in main housing 104.

FIG. 6C shows a face on cross-sectional view of rail mountable device 100 in a disengaged configuration. In the example of FIG. 6C, rail 103 is indicated by dashed line 635. As shown, in the disengaged configuration, a cavity 622 formed at least in part by rail engagement members 102, cross member 206 and retracted ramp members 110 and 118 provides sufficient room for rail 103 to slide into cavity 622 along a direction substantially parallel to the elongated dimension of members 102. For example, rail mountable device 100 is slidably placed on rail 103 in the disengaged configuration using rail engaging surface 602 and rail-engaging surface 604 to guide rail mountable device 100 onto the rail 103. Once the rail mountable device 100 has been slid onto rail 103 and rail 103 is disposed in cavity 622, rail-engaging surfaces 602 and 604 may extend longitudinally along rail 103 and may rest on rail 103.

As shown in FIG. 6C, ramp member 110 has inclined surfaces 606 and 608 which are slidably disposed in contact with complementary inclined ramp-engaging surfaces 614 and 616 of main housing 104. Similarly ramp member 118 may have inclined surfaces 610 and 612 which are slidably disposed in contact with ramp-engaging surfaces 618 and 620. When screw 112 is rotated about the central axis in a first direction to turn screw 112 into cross member 206, ramp members 110 and 118 may be simultaneously pulled together into cavity 622 from respective slots 623 and 625. The motion of ramp member 110 may be guided by the contact between surface 606 of ramp member 110 and surface 614 of housing 104 and by the contact on an opposing side of ramp member 110 between surface 608 of ramp member 110 and surface 616 of housing 104. The motion of ramp member 118 may be guided by the contact between surface 610 of ramp member 118 and surface 618 of housing 104 and by the contact on an opposing side of ramp member 118 between surface 612 of ramp member 118 and surface 620 of housing 104. In this way, ramp members 110 and 118 may move closer together along the central axis of screw 112 while the entire rail clamp 500, including cross member 206 and the central axis 201, moves up as indicated by arrow 637. In this way, rail engaging surfaces 208 and 212 of ramp members 110 and 118 may be moved toward corresponding surfaces 645 and 643 of rail 103 and surface 210 of cross member 206 may be moved upward into the groove (slot) 900 (see FIGS. 9A and 9B) to move rail mountable device 100 from the disengaged configuration to the engaged configuration secured to rail 103 as illustrated in FIGS. 7A, 7B, and 7C.

Figure 7A:
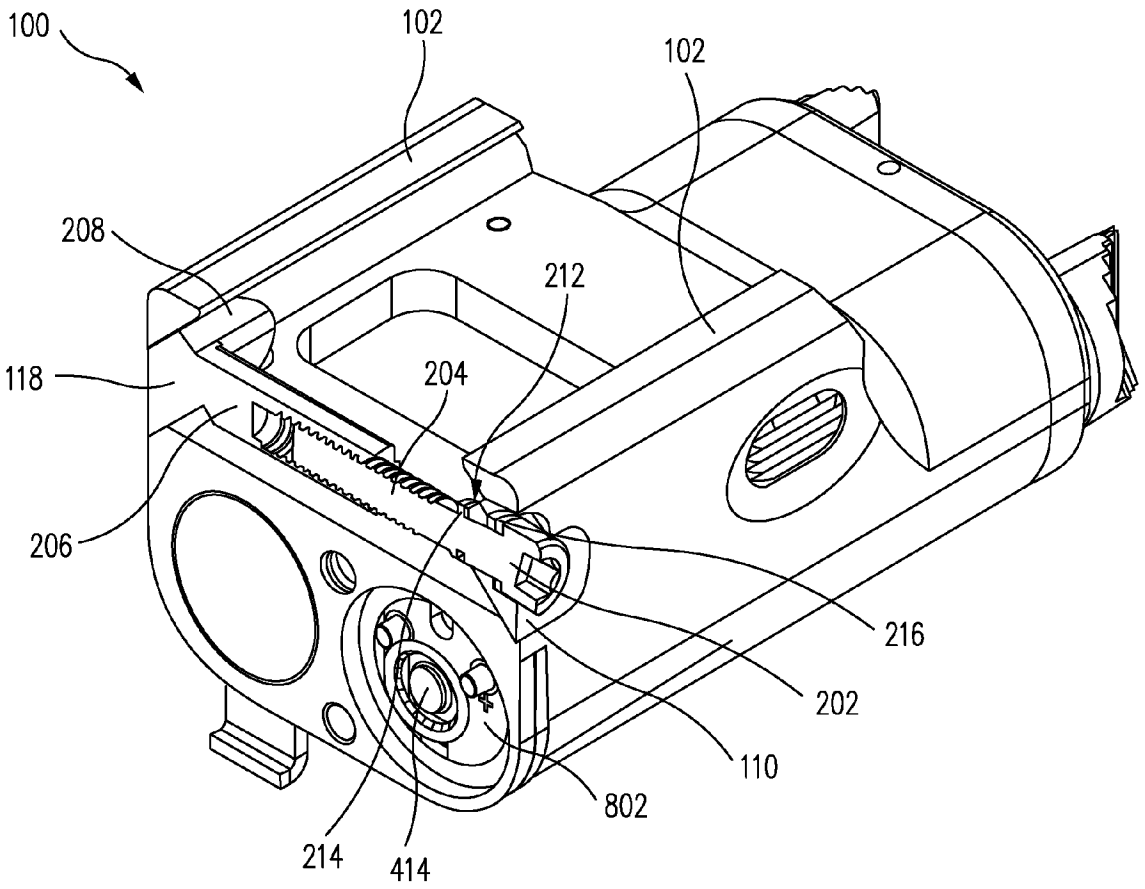
FIGS. 7A, 7B, and 7C illustrate several cross-sectional views of a rail mountable device with a rail clamp in an engaged position taken along line 7-7 of FIGS. 3A, 3B, and 3C in accordance with several embodiments of the disclosure.
Figure 7B:
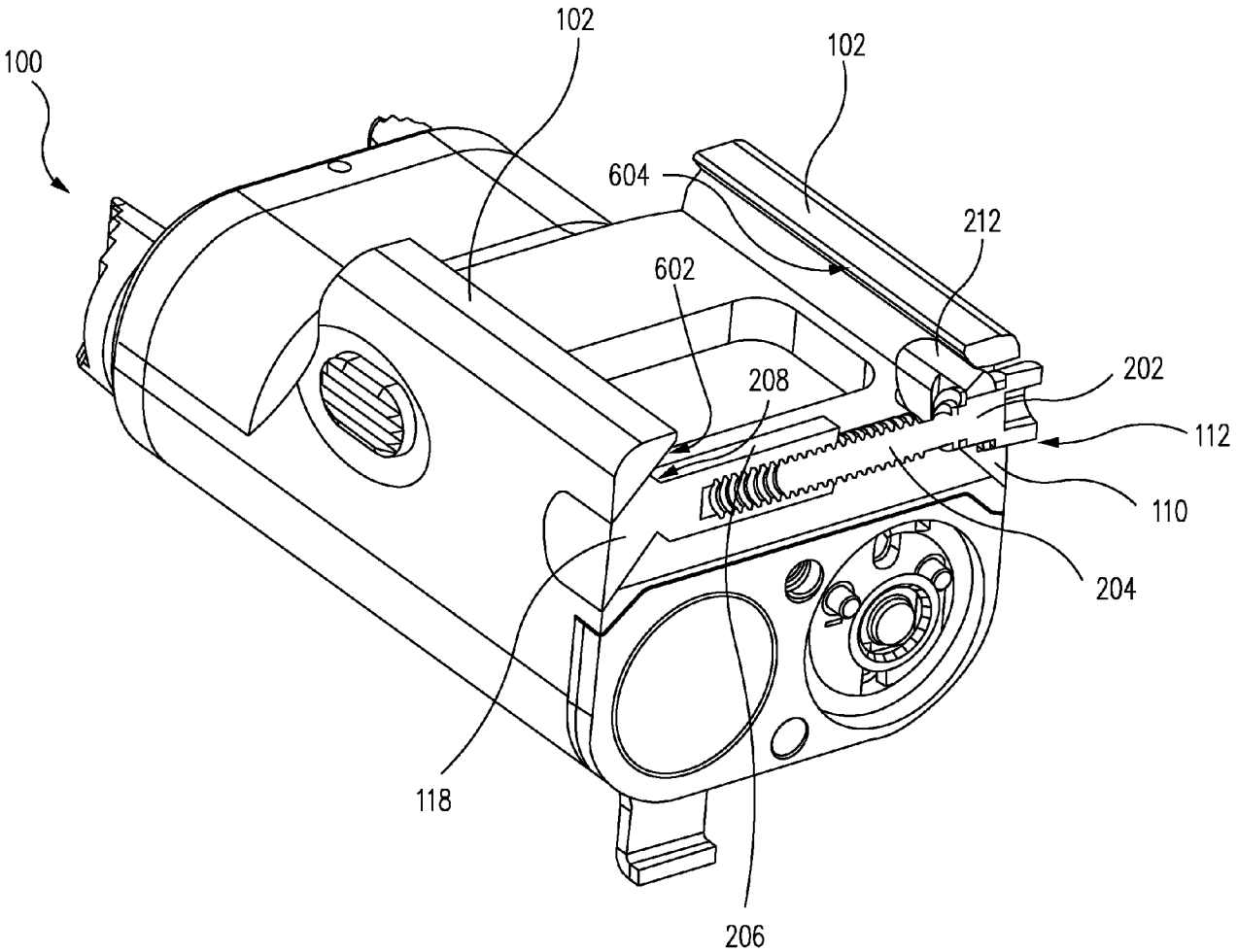
Figure 7C:
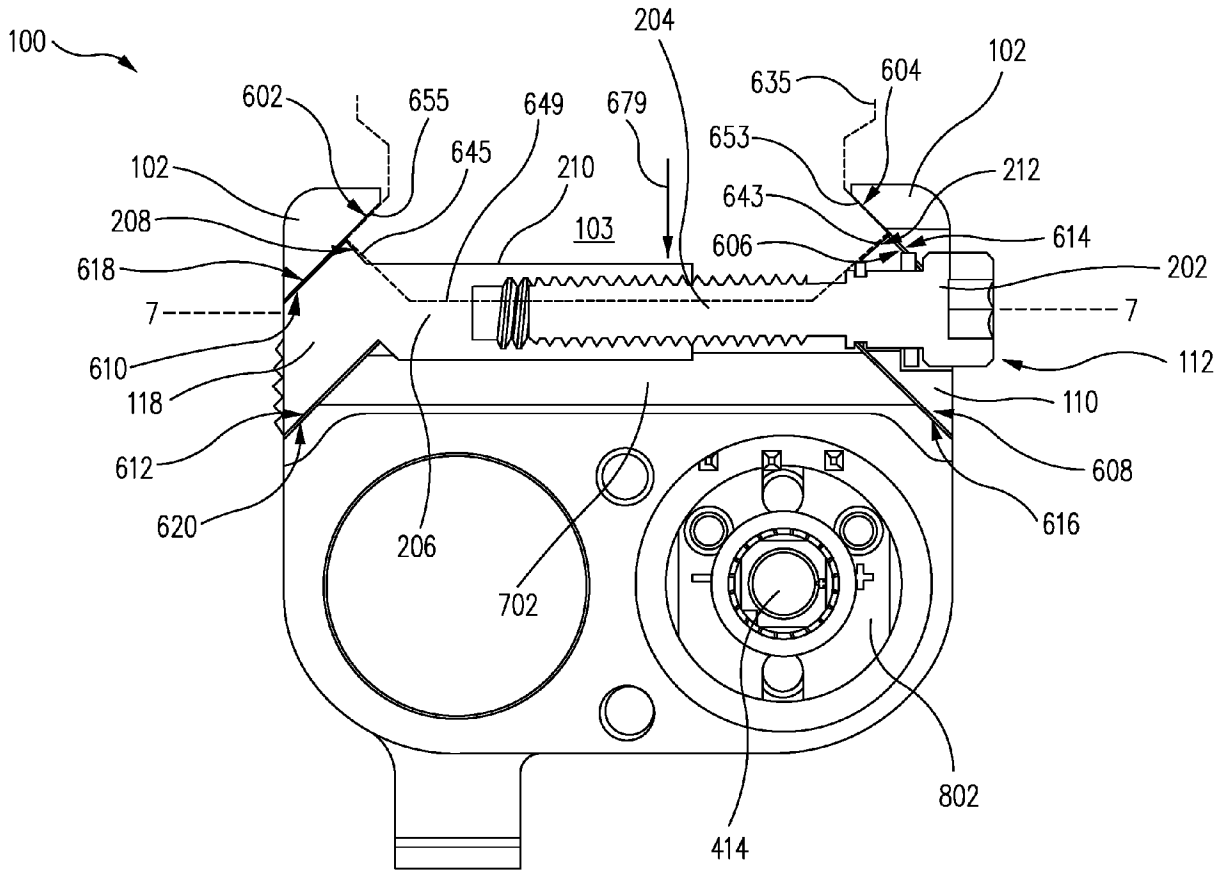

FIGS. 7A, 7B, and 7C show cross-sectional perspective views of rail mountable device 100 in the engaged configuration with the cross section taken along line 7-7 of FIGS. 3A, 3B, and 3C (and through the central axis of rail clamp 500) in accordance with several embodiments. FIG. 7A provides a left upper front perspective cross-sectional view of rail mountable device 100 in the engaged configuration. For example, to move rail mountable device 100 from the disengaged configuration of FIG. 6A to the engaged configuration of FIG. 7A, screw 112 may be twisted concentrically about the central axis (e.g., clockwise) to generate an axial force that causes the movement of ramp members 110 and 118 up their corresponding slots in main housing 104 into cavity 622. This axial force and the associated movement of ramp members 110 and 118 up their corresponding slots may close the distance between rail-engaging surfaces 208 and 212 along the central axis. The axial force and the associated movement of ramp members 110 and 118 up their corresponding slots may also close the distance between rail-engaging surface 208 and rail surface 645 and between rail engaging surface 212 and rail surface 643.

FIG. 7B shows a right upper front perspective cross-sectional view of rail mountable device 100 in the engaged configuration. In an embodiment, ramp members 110 and 118, in their engaged positions, may be disposed in their corresponding slots in main housing 104 with a maximum amount of surface contact between ramp-engaging surfaces 614, 616, 618 and 620 of main housing 104 and inclined surfaces 606, 608, 610 and 612 of ramp members 110 and 118.

FIG. 7C shows a face-on cross-sectional view of rail mountable device 100 in an engaged position and secured to rail 103, which is indicated by the dashed line 635 in FIG. 7C as in FIG. 6C. As shown, in the engaged configuration, cavity 622 formed by rail engagement members 102 and ramp members 110 and 118 in their engaged positions is substantially filled by rail 103.

As shown in FIG. 7C, the axial force created by screw 112 and cross member 206 as well as the pressure between ramp-engaging surfaces 614, 616, 618 and 620 of main housing 104 and inclined surfaces 606, 608, 610 and 612 of ramp members 110 and 118 may hold and lock rail engaging surfaces 208 and 212 of ramp members 110 and 118 against respective surfaces 645 and 643 of rail 103, may hold and lock cross member 206 within slot 900, and may hold and lock rail engaging surfaces 602 and 604 of rail engaging members 102 against corresponding surfaces 655 and 653 of rail 103 to secure rail mountable device 100 to rail 103. In this way, the axial force created by screw 112 and cross member 206 as well as the pressure between ramp-engaging surfaces 614, 616, 618 and 620 of main housing 104 and inclined surfaces 606, 608, 610 and 612 of ramp members 110 and 118 may lock rail mountable device 100 both horizontally and vertically to rail 103 (e.g., by locking both the horizontal and vertical position of rail mountable device 100 with respect to rail 103, thereby clamping rail mountable device 100 both horizontally and vertically to rail 103).

As shown in FIG. 7C, the bottom surface 649 of rail 103 may extend below the top surface 210 of cross member 206 when rail mountable device 100 is in the engaged position because a portion of cross member 206 is disposed within a transverse groove or slot in the rail. Rail engaging surfaces 208 and 212 may provide forces on opposing sides of rail 103 (e.g., on respective surfaces 645 and 643) that each have inward and upward directional components with respect to the rail. Rail engaging surfaces 602 and 604 may provide forces on opposing sides of rail 103 (e.g., on respective surfaces 655 and 653) that each have inward and downward directional components with respect to the rail. The upward and downward forces generated by ramp members 110 and 118 and rail engagement members 102 may vertically lock the position of rail mountable device 100 with respect to rail 103. The inward forces generated by ramp members 110 and 118 and rail engagement members 102 may horizontally lock the position of rail mountable device 100 with respect to rail 103 in a first horizontal dimension. Engagement between sidewall surfaces of cross member 206 and complementary sidewall surfaces of groove 900 may horizontally lock the position of rail mountable device 100 with respect to rail 103 in a second horizontal dimension that is perpendicular to the first horizontal dimension.

When screw 112 is rotated about the central axis in a second direction to unscrew screw 112 from cross member 206, ramp members 110 and 118 may be simultaneously pushed apart away from cavity 622 into respective slots 623 and 625. The motion of ramp member 110 may be guided by the contact between surface 606 of ramp member 110 and surface 614 of housing 104 and by the contact on an opposing side of ramp member 110 between surface 608 of ramp member 110 and surface 616 of housing 104. The motion of ramp member 118 may be guided by the contact between surface 610 of ramp member 118 and surface 618 of housing 104 and by the contact on an opposing side of ramp member 118 between surface 612 of ramp member 118 and surface 620 of housing 104. In this way, ramp members 110 and 118 may move further apart along the central axis of screw 112 while the entire rail clamp 500, including cross member 206 and the central axis, moves down as indicated by arrow 679. In this way, rail engaging surfaces 208 and 212 of ramp members 110 and 118 may be moved away from corresponding surfaces 645 and 643 of rail 103 and cross member 206 may be moved downward out of groove 900 (see FIGS. 9A and 9B) so that top surface 210 of cross member 206 moves downward beyond bottom surface 649 of rail 103 to move rail mountable device 100 from the engaged configuration to the disengaged configuration for removal from rail 103.

The cross-sectional views of FIGS. 6A, 6B, 6C, 7A, 7B, and 7C also show circuitry 802 and light source 414 of rail mountable device 100. Circuitry 802 may, for example, be a printed circuit board for controlling light source 414. For example, light source 414 may project light onto an optic such as optic 116 disposed in front housing 410 to generate a light beam for illuminating an external scene of interest.

Figure 8A:
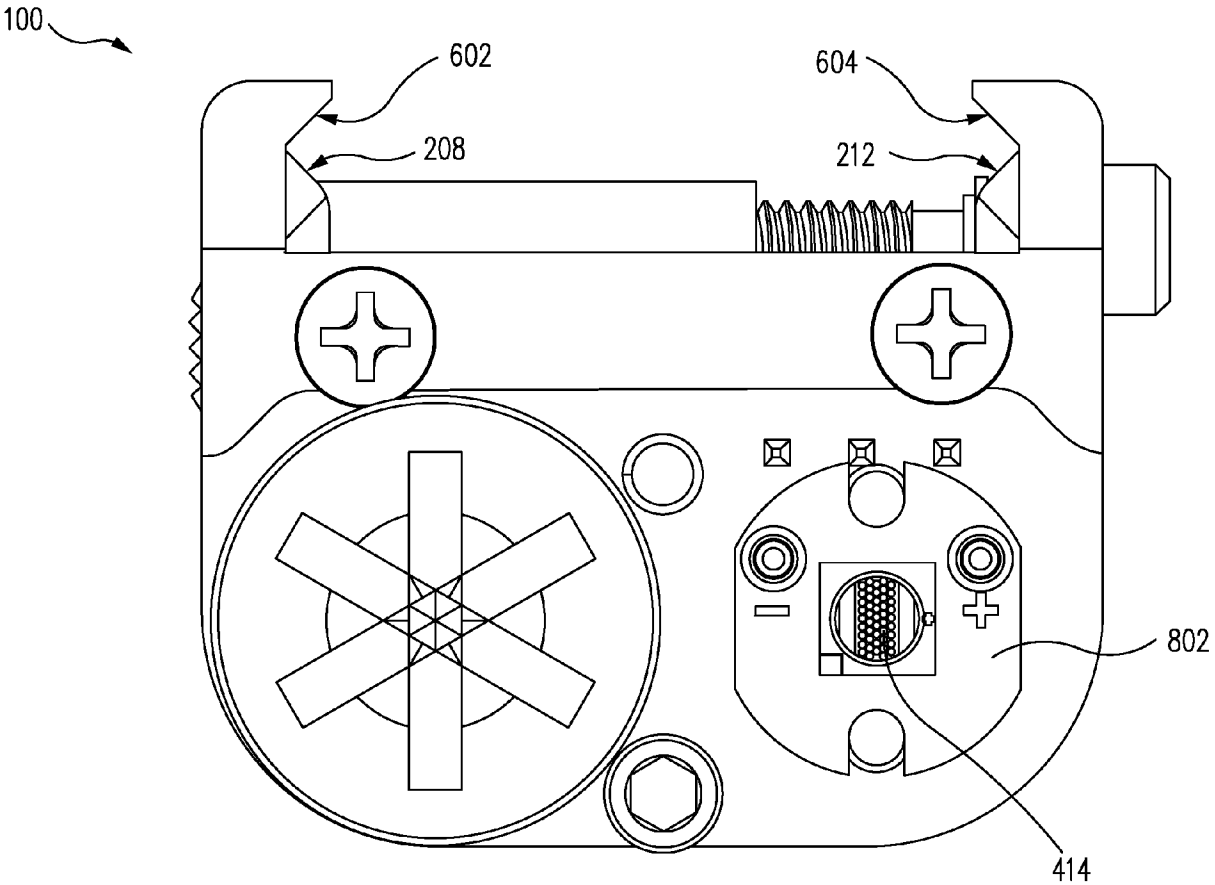
FIGS. 8A and 8B illustrate several views of a circuit board disposed in a rail mountable device in accordance with several embodiments of the disclosure.
Figure 8B:
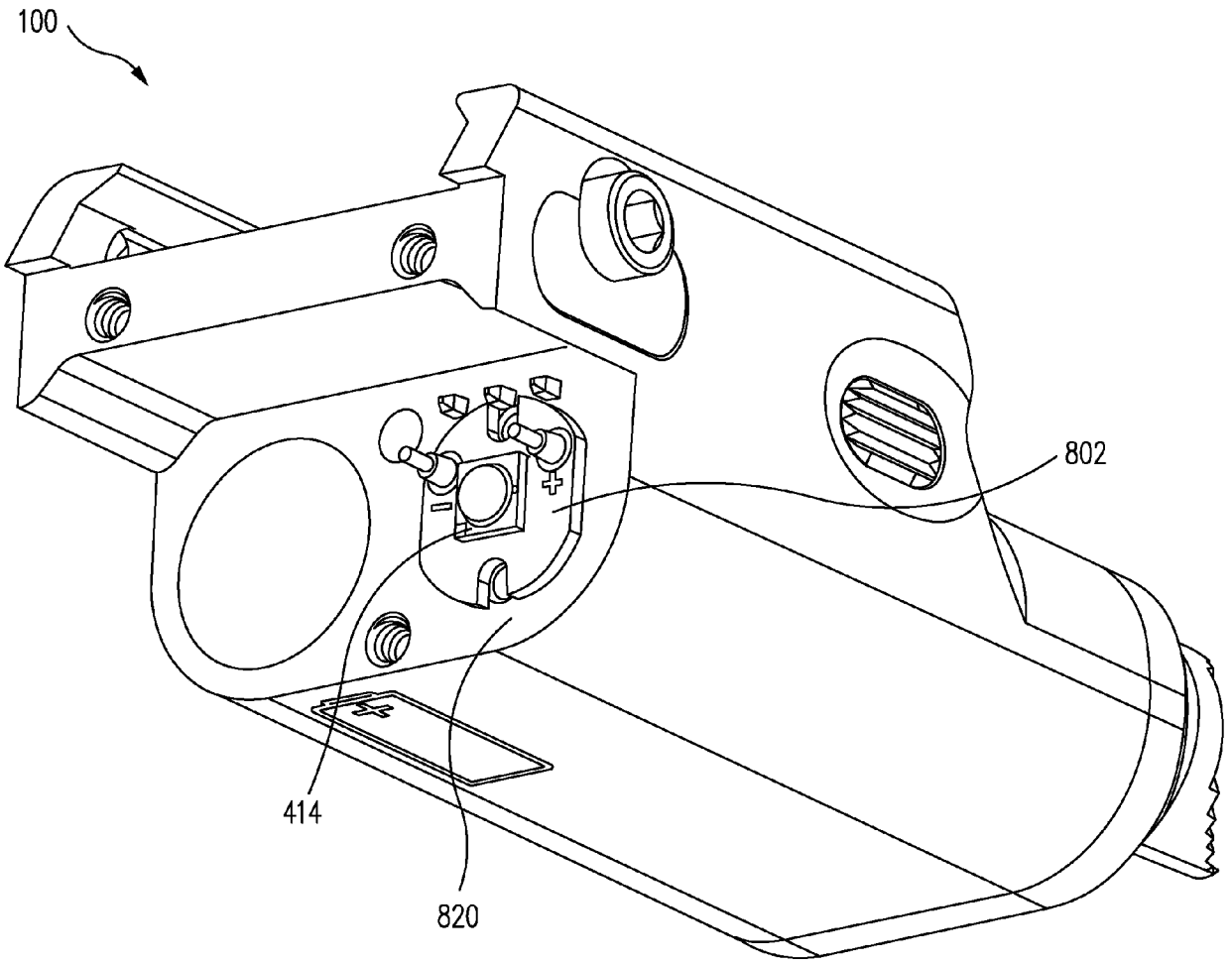

FIGS. 8A and 8B respectively show face-on and perspective views of rail mountable device 100 with front housing 410 removed from main housing 104 to expose circuit board 802 and light source 414 in accordance with several embodiments. As shown, circuit board 802 may be mounted to a front face 820 of main housing 104. Light source 414 may be mounted to circuit board 802 and at least partially enclosed by optic 116 (not shown). Main housing 104 may be adapted to dissipate heat associated with circuit board 802 and/or light source 414.

In various embodiments, light source 414 may include a single light source such as a light-emitting diode (LED) or a laser light source (e.g., for a laser sighting system) or may include a plurality of light sources in a light source assembly attached to circuit board 802. Light source 414 may include one or more white light sources, one or more infrared light sources, one or more ultraviolet light sources, and/or other types of light sources. In one embodiment, light source 414 may include a plurality of white light LEDs that are grouped together, and may further include a plurality of infrared light LEDs that are grouped together.

Light source 414 may include other light sources or groups of light sources. For example, in various embodiments, light source 414 may include one or more red light sources, one or more green light sources, and/or one or more blue light sources. Light source 414 may include one light source or a plurality of any desired number of groups of light sources and each group of light sources may include any desired number and/or combination of light sources. Accordingly, discussion herein of white light sources and infrared light sources is by way of example only, and not by way of limitation. Rail mountable device 100 may include a single light source and a single optic, multiple light sources and a single optic, and/or multiple light sources and multiple optics for generating a light beam to be projected onto an external scene of interest.

Figure 9A:
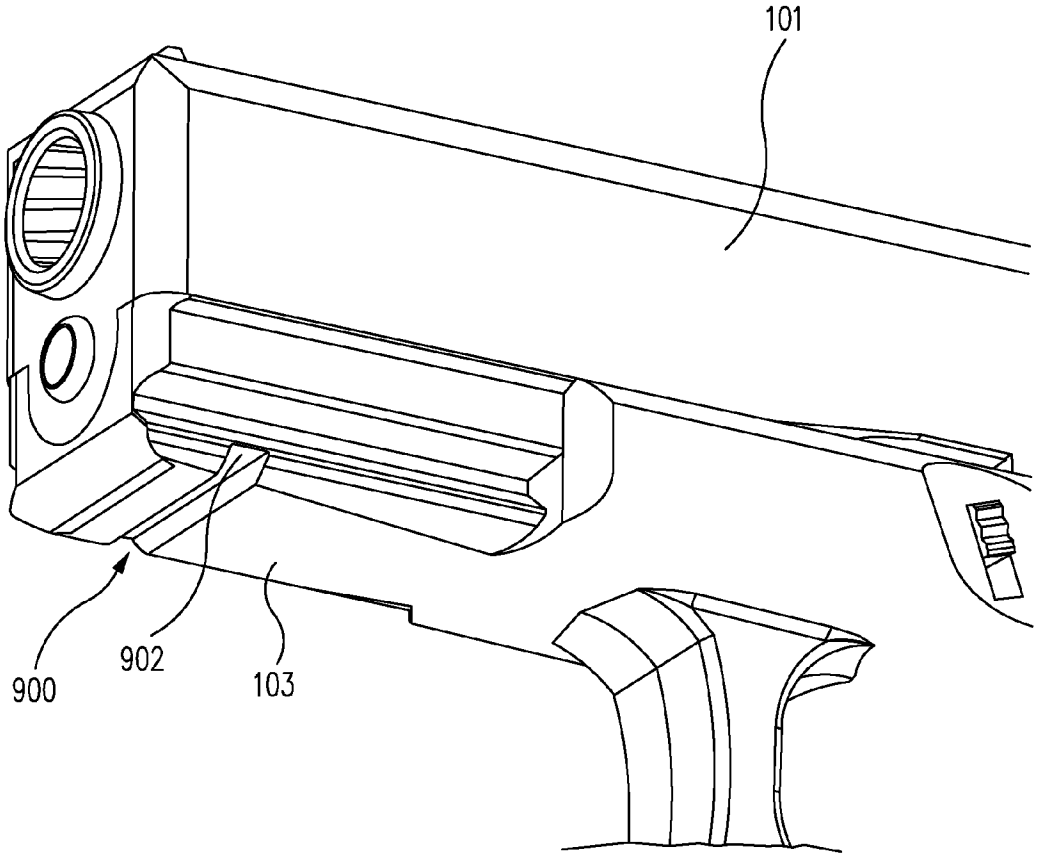
FIGS. 9A and 9B illustrate several views of a firearm having a rail with a transverse groove in accordance with several embodiments of the disclosure.
Figure 9B:
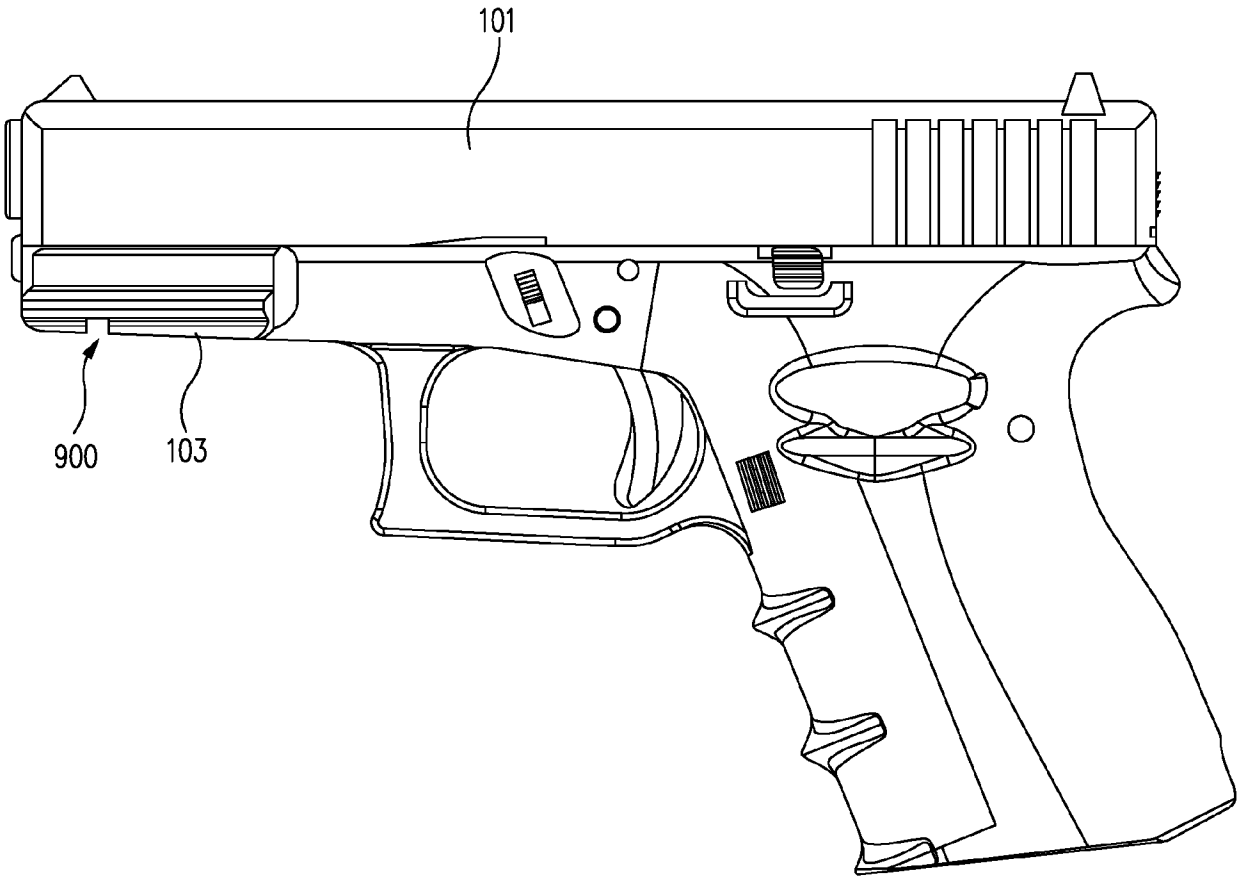

FIGS. 9A and 9B respectively show perspective and side views of a rail 103 attached to a firearm and show how rail 103 may include a transverse groove 900 that runs perpendicularly to an elongated dimension of the rail and to the elongated dimension of the barrel in accordance with several embodiments. Cross member 206 of rail mountable device 100 may have a size, a shape, and a position within rail mountable device 100 such that, in the engaged configuration when rail mountable device 100 is secured to rail 103, at least a portion of cross member 206 is disposed within groove 900 to help prevent forward and backward movement of rail mountable device 100 along rail 103.

In this way, when screw 112 is rotated to secure rail mountable device 100 to rail 103, the cross member 206 may be received into a groove of the rail in response to the rotation. Top surface 210 of cross member 206 (see, e.g., FIG. 7C) may be moved in response to the rotation into contact with surface 902 within slot 900. However, this is merely illustrative and in other embodiments, cross member may be engaged within slot 900 without contacting surface 902 or may merely be pressed against a bottom surface of the rail in an engaged position.

The disclosure is not intended to limit the present invention to the precise forms or particular fields of use disclosed. It is contemplated that various alternate embodiments and/or modifications to the present invention, whether explicitly described or implied herein, are possible in the rail clamp of the disclosure. For example, it is contemplated that the various embodiments set forth herein may be combined together and/or separated into additional embodiments where appropriate.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A device configured to mount on a rail associated with a weapon, the device comprising:
- a housing; and
- a rail clamp comprising:
  - first and second opposed ramp members,
  - a cross member connected to the second ramp member,
  - a screw adapted to project through the first ramp member and be received by the cross member along a central axis, and
  - wherein the ramp members are adapted to be, in response to a rotation of the screw, simultaneously: pulled toward each other along the central axis, and slid against complementary surfaces of the housing to move the rail clamp toward the rail in a direction substantially perpendicular to the central axis to lock the device with respect to movement in the substantially perpendicular direction.

2. The rail mountable device of claim 1, wherein the rotation causes corresponding rail-engaging surfaces of the ramp members to contact the rail.

3. The rail mountable device of claim 1, wherein the ramp members are adapted to be simultaneously pushed away from each other along the central axis and slid against the complementary surfaces of the housing to move the rail clamp away from the rail in an opposite direction substantially perpendicular to the central axis in response to an opposite rotation of the screw.

4. The rail mountable device of claim 1, wherein the complementary surfaces of the housing are inclined surfaces relative to the central axis and the ramp members comprise substantially inclined surfaces relative to the central axis adapted to slide against the complementary inclined surfaces of the housing in response to the rotation to move the rail clamp in the substantially perpendicular directions.

5. The rail mountable device of claim 1, wherein the cross member is adapted to be received into a groove of the rail in response to the rotation.

6. The rail mountable device of claim 1, wherein the housing comprises first and second rail-engaging surfaces adapted to slide relative to the rail and adapted to contact the rail while the device is mounted to the rail.

7. The rail mountable device of claim 1 further comprising a light source disposed in the housing and adapted to provide light while the device is mounted on the rail.

8. The rail mountable device of claim 7, wherein:
- the housing comprises a front housing and a main housing;
- the device further comprises:
  - a circuit board mounted on a front face of the main housing and connected to the light source, and
  - an optical element substantially enclosed by the front housing and adapted to project the light received from the light source; and
- the main housing is adapted to dissipate heat associated with the circuit board.

9. The rail mountable device of claim 1, wherein the rail is a Picatinny rail.

10. A method, comprising:
- providing a device configured to mount on a rail associated with a weapon, the device comprising:
  - a housing, and
  - a rail clamp comprising:
    - first and second opposed ramp members,
    - a cross member connected to the second ramp member, and
    - a screw adapted to project through the first ramp member and be received by the cross member along a central axis; and
- rotating the screw, wherein the ramp members, in response to the rotating, are simultaneously:
  - pulled toward each other along the central axis, and
  - slid against complementary surfaces of the housing to move the rail clamp toward the rail in a direction substantially perpendicular to the central axis to lock the device with respect to movement in the substantially perpendicular direction.

11. The method of claim 10, wherein the rotating causes corresponding rail-engaging surfaces of the ramp members to contact the rail.

12. The method of claim 10, wherein the rotating is performed in a first direction, the method further comprising rotating the screw in a second opposite direction, wherein the ramp members, in response to the rotating in the second opposite direction, are simultaneously pushed away from each other along the central axis and slid against the complementary surfaces of the housing to move the rail clamp away from the rail in an opposite direction substantially perpendicular to the central axis.

13. The method of claim 10, wherein the complementary surfaces of the housing are inclined surfaces relative to the central axis and the ramp members comprise substantially inclined surfaces relative to the central axis adapted to slide against the complementary inclined surfaces of the housing in response to the rotating to move the rail clamp in the substantially perpendicular direction.

14. The method of claim 10, wherein the cross member is adapted to be received into a groove of the rail in response to the rotating.

15. The method of claim 10, wherein the housing comprises first and second rail-engaging surfaces adapted to slide relative to the rail in response to the rotating and adapted to contact the rail while the device is mounted to the rail.

16. The method of claim 10, further comprising operating a light source disposed in the housing, wherein the light source is adapted to provide light while the device is mounted on the rail.

17. The method of claim 16, wherein:
- the housing comprises a front housing and a main housing;
- the device further comprises:
  - a circuit board mounted on a front face of the main housing and connected to the light source, and
  - an optical element substantially enclosed by the front housing and adapted to project the light received from the light source; and
- the method further comprises dissipating, by the main housing, heat associated with the circuit board.

18. The method of claim 10, wherein the rail is a Picatinny rail.

* * * * *